US005919030A

United States Patent [19]

Iwatake et al.

[11] Patent Number: 5,919,030

[45] Date of Patent: Jul. 6, 1999

[54] ELECTRIC FAN

[75] Inventors: Makoto Iwatake; Hideki Ochi, both of Kasai; Yuji Fujiwara, Kako-gun; Hideya Tsuchida, Kasai, all of Japan

[73] Assignee: Sanyo Electric Co., Ltd, Osaka, Japan

[21] Appl. No.: 08/823,756

[22] Filed: Mar. 25, 1997

[30] Foreign Application Priority Data

Mar. 29, 1996 [JP] Japan ..... 8-099542
Mar. 29, 1996 [JP] Japan ..... 8-099543

[51] Int. Cl.[6] ..... F04D 29/66

[52] U.S. Cl. ..... 415/119; 415/208.3; 181/231; 15/326

[58] Field of Search ..... 415/119, 208.3, 415/208.2; 181/231, 229, 230; 15/326

[56] References Cited

U.S. PATENT DOCUMENTS

| | | | |
|---|---|---|---|
| 2,225,398 | 12/1940 | Hamblin . | |
| 4,057,370 | 11/1977 | Numata et al. | 415/119 |
| 4,065,233 | 12/1977 | Torigoe et al. | 415/211 |
| 4,111,615 | 9/1978 | Watanabe | 415/119 |
| 4,131,389 | 12/1978 | Perrone et al. . | |
| 5,110,266 | 5/1992 | Toshiyama et al. | 417/312 |
| 5,513,417 | 5/1996 | Kim et al. | 15/326 |

FOREIGN PATENT DOCUMENTS

| | | | |
|---|---|---|---|
| 10-96356 | 1/1961 | Denmark . | |
| 61-207899 | 2/1987 | Japan . | |
| 406030861 | 2/1994 | Japan | 15/326 |
| 2-079853 | 1/1982 | United Kingdom . | |

*Primary Examiner*—Thomas E. Denion
*Assistant Examiner*—Richard Woo
*Attorney, Agent, or Firm*—Armstrong, Westerman, Hattori, McLeland & Naughton

[57] ABSTRACT

An electric fan comprises: a radial impeller for expelling the air trapped therein out of the impeller; a diffuser having a multiplicity of air passages separated by air guides, the air passages adapted to receive the air expelled from the impeller; a fan case for covering the impeller and the air guides; at least one throughhole which is formed in the fan case for each of the air passages; and a silencer equipped with a multiplicity of silencer cavities each having a predetermined volume and communicating with a corresponding one of the air passages, the silencer covering the fan case. The silencer is provided either on top of or beneath the fan case. Because the volumes of these silencer cavities may be chosen arbitrarily such that the silencer cavities may absorb noise caused by the interference between the impeller and the air passages, even audible noise may be suppressed sufficiently.

18 Claims, 40 Drawing Sheets

ELECTRIC FAN

FIELD OF THE INVENTION

The invention relates to an electric fan, and more particularly, to an electric fan for use in an electric vacuum cleaner, having a silencer for suppressing noise caused by the interference between an impeller and an air passage in the fan.

KNOWN ART

In an attempt to provide a compact and yet efficient electric vacuum cleaner, a high speed impeller is utilized for generating a strong radial airflow and resultant high vacuum in an air intake of the electric fan.

Such an electric fan as mentioned above has a motor cover on which an air-tight casing is sealingly mounted. The casing has a central air intake port. Accommodated in the casing is an impeller having a multiplicity of radial blades that extend from a shaft of the motor.

A diffuser is disposed between the motor cover and the impeller. The diffuser has a peripheral section having a multiplicity of air guides which extend radially to form air passages between them for guiding the air expelled from the impeller in a radial direction. The air passages have radial dimensions which become larger in the radial direction.

Formed on the backside of the diffuser is a air return passage for the air to return from the air passage back to the air intake.

In this electric vacuum cleaner, if the impeller is rotated, the air in the impeller is expelled out of it to the air passages, so that the pressure in the air intake port becomes negative, that is, the air intake port is evacuated. This negative pressure enables suction of dusty air from the suction port of the vacuum cleaner.

It has been known, however, that the electric fan has a disadvantage that it gives rise to noise (hereinafter referred to as NZ noise for the reason described below) caused by an interference between the impeller and the air passages, the intensity of the noise being proportional to the product of the number N of impeller blades and the rotational frequency Z of the impeller.

One prior art solution is to provide a number of small bores in some regions of the air passages, as disclosed in Japanese Patent Early Publication No, 61-207899, in particular FIGS. 2 and 3. According to this known art, these small bores may absorb or suppress the NZ noise.

SUMMARY OF THE INVENTION

It is found that in order to suppress the NZ noise sufficiently by absorption, each of the bores must have a substantial volume. However, this is a disadvantage since such large throughholes inevitably sacrifice the cross section of the air return passage, thereby reducing an over all airflow efficiency of the fan.

Further, the throughholes can be provided only in the axial direction of the shaft of the motor, so that it is structurally difficult to enlarge the volumes of dead-ended the throughholes.

The fact that the volume of each bore is limited implies that only high frequency NZ noise can be eliminated, since the frequency of the NZ noise that can be absorbed by the bores is determined by the volume of the bore. On account of this limitation, the prior art electric fan has suppression effect mainly in a high frequency region, but only little effect in low frequency.

Unfortunately, the frequency of the NZ noise varies with the rotational speed of the fan. As a result, when the speed of the motor is varied in adjusting the suction power of the cleaner, bores having a definite size are no longer effective, so that such bores cannot be effective over the entire speed range of the fan.

These bores are formed in the diffuser perpendicularly to the air passages, so that the pressure increases fluid dynamically in the air passage than in the bores when the velocity of the airflow in the air passage is great. Under such condition, the air comes into the bores, thereby creating turbulence in the air passage, which in turn generates another type of noise called cavity noise and, in addition, lowers airflow rate (or effective power) of the electric fan.

There is accordingly a need for an electric fan which is free of these disadvantages regarding the silencer cavities or bores in the air passage, and has sufficient silencing effect for the NZ noise.

It is, therefore, an object of the invention to provide an electric fan having a silencer whose silencer cavities or bores can be of any size and configuration.

It is another object of the invention to provide an electric fan which may suppress noise sufficiently over multiple frequencies of the motor fan.

It is still another object of the invention to provide an electric fan which gives rise to little cavity noise and has a resultant improved airflow rate.

According to the present invention, there is provided an electric fan comprising: a radial impeller for expelling the air trapped therein out of the impeller; a diffuser having a multiplicity of air passages separated by air guides, the air passages adapted to receive the air expelled from the impeller; a fan case for covering the impeller and the air guides; at least one throughhole which is formed in the fan case for each of dead-ended the air passages; and a silencer equipped with a multiplicity of silencer cavities each having a predetermined volume and communicating with a corresponding one of the air passages.

In this arrangement, because the volumes of these silencer cavities may be chosen arbitrarily such that the silencer cavities may absorb the noise having given frequencies, even the noise in an audible range generated by the interference between the impeller and the air passage may be sufficiently suppressed by the silencer chambers.

These and other features of the present invention may be more readily understood by reference to the following description, taken in conjunction with the accompanying drawings. Details of the invention has been also disclosed in outstanding Japanese Patent Applications Nos. 8-99542 and 8-99543 filed on Mar. 29, 1996, respectively. The entire disclosure of these Japanese Patent Applications including specifications, claims, drawings and summaries thereof are incorporated herein by reference in its entirety.

BRIEF DESCRIPTION OF THE DRAWINGS

Preferred embodiments of the invention will now be described in conjunction with the accompanying drawings, in which.

In these figures, like reference characters designate like or corresponding features throughout the figures.

DETAILED DESCRIPTION OF THE PREFERRED EMBODIMENT

Figure 1A:
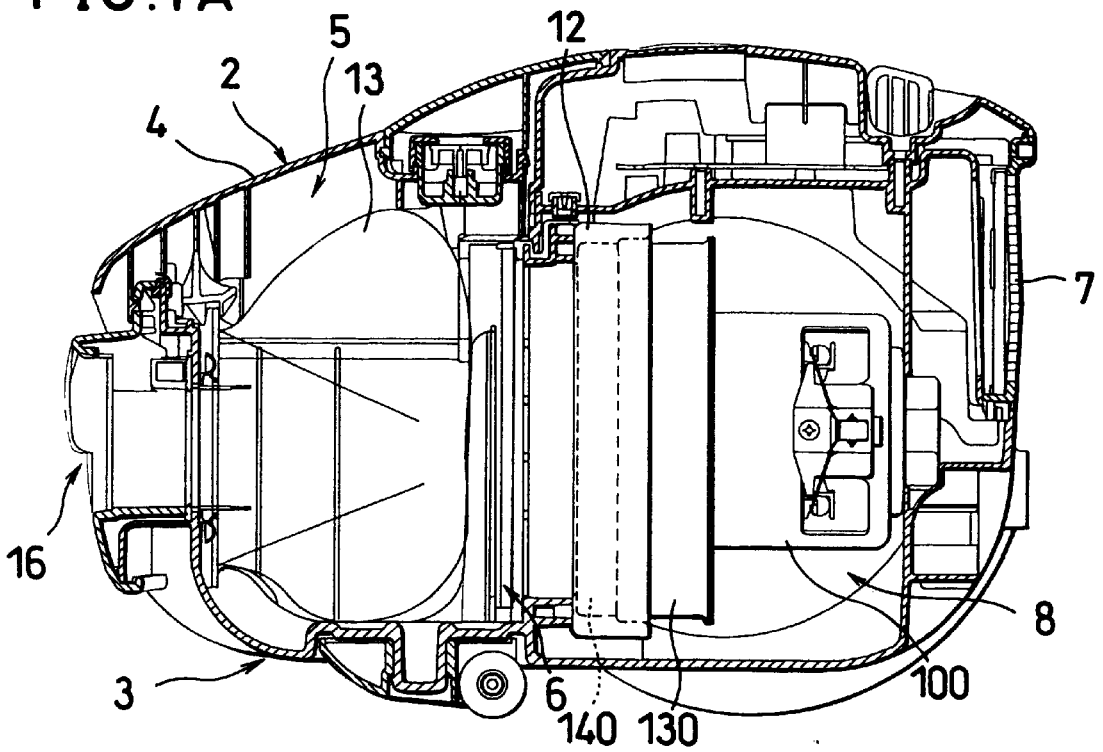
FIGS. 1*a* and 1*b* are a vertical cross section and a transverse cross section, respectively, of an vacuum cleaner equipped with a first electric fan according to the invention.
Figure 1B:
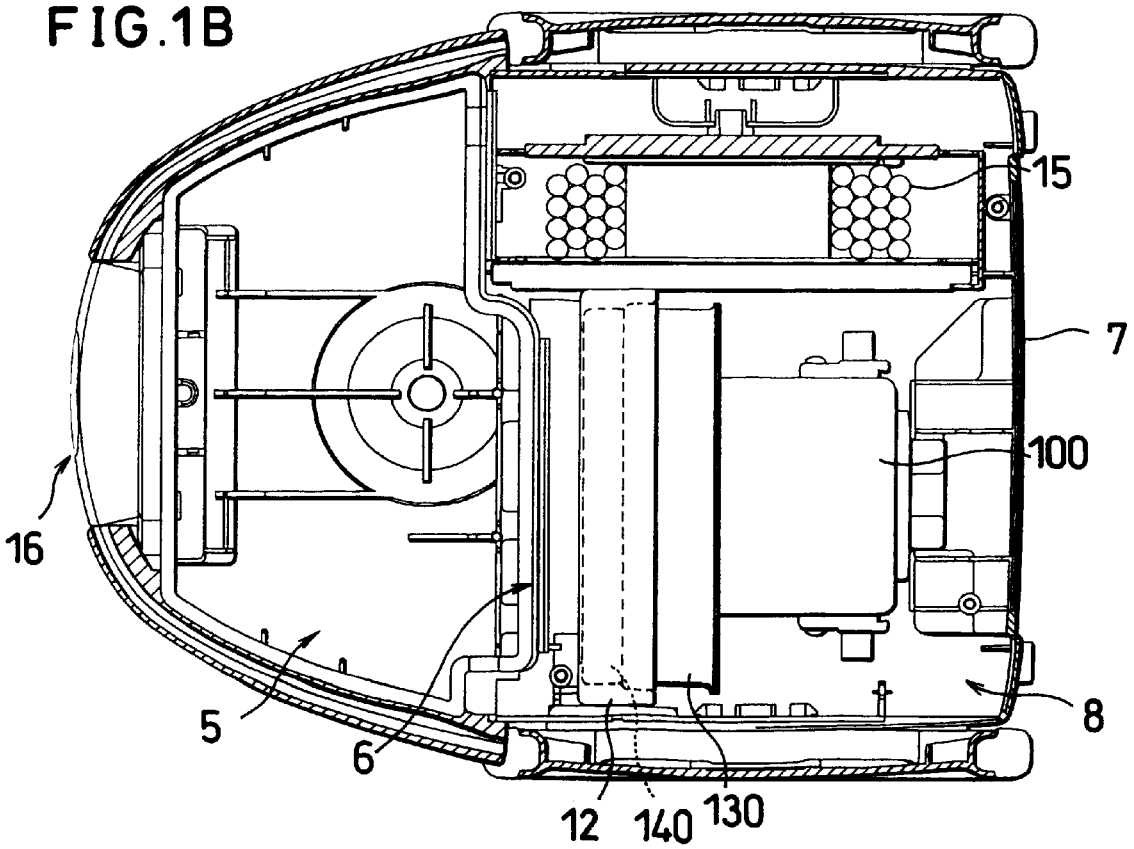
Figure 2:
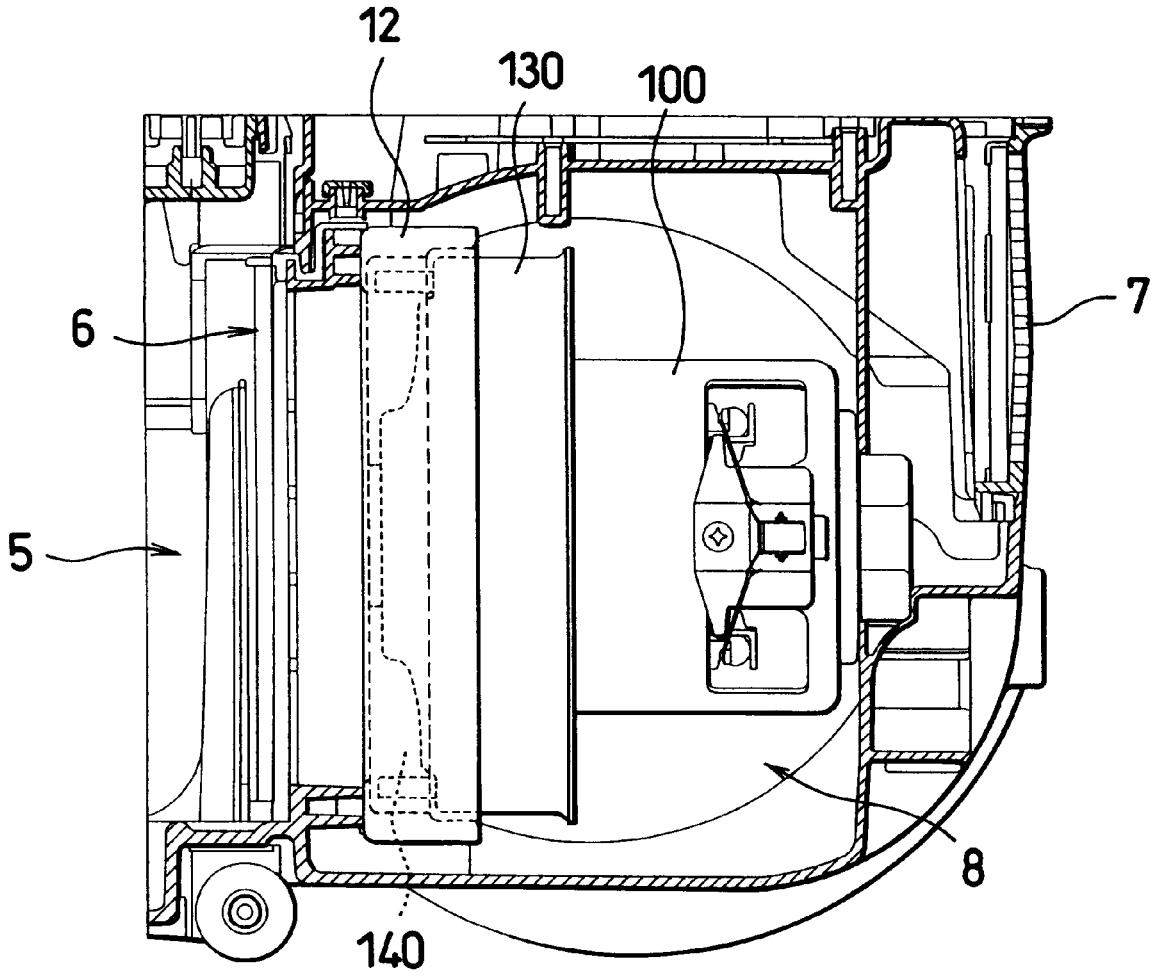
FIG. 2 is an enlarged fragmentary cross section of the electric fan of FIG. 1(*a*).

Referring now to FIGS. 1 through 6, there is shown a first example of an electric fan of the invention for use with a vacuum cleaner. As shown in FIGS. 1 and 2, the electric vacuum cleaner has an upper case 2 and a lower case 3, which may be coupled together, forming an exterior case of the cleaner. Accommodated in the exterior case are dust collection chamber 5 and a fan chamber 8 on the opposite sides of an opening 6.

In front of the dust collection chamber 5 is an air intake port 16 on which a suction hose may be removably mounted. Removably mounted behind the air intake port 16 is a filter 13 in the form of paper bag. The dust collection chamber 5 is provided with a dust lid 4 which may be opened when replacing the filter 13. An electric fan 100 is accommodated in the fan chamber 8. The electric fan 100 is furnished with electric power through a care 15. An air outlet port 7 is provided behind the electric fan 100.

The electric fan 100 abuts the opening 6 via an annular shock damper 12, which damps, on one hand, vibrations transmitted to and from the motor of the electric fan 100, and on the other hand seals the opening 6 so that the air is taken in only from the inlet port 16.

Figure 3:
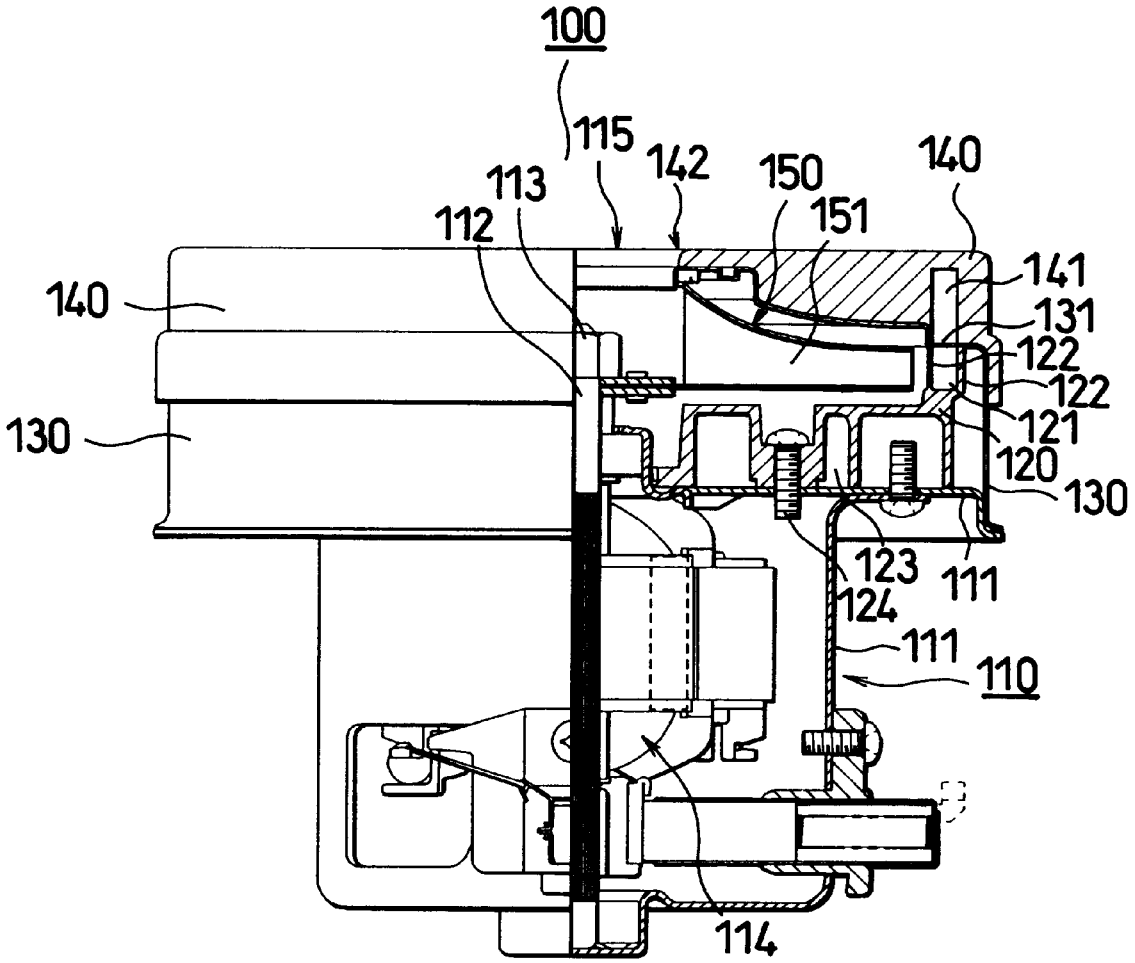
FIG. 3 is a side elevation of the electric fan of FIG. 2 in schematic view on the left half of the figure, and in cross section on the right half of the figure.

As shown in FIG. 3, the electric fan 100 has a motor unit 110, a diffuser 120, an impeller 150, a fan case 130, and a silencer 140.

The motor unit 110 has an electric motor 114 covered with a motor cover 111. The motor cover 111 is mounted on the diffuser 120 by screws 124. Mounted by nuts 113 on the shaft 112 of the motor is an impeller 150 which has a multiplicity of radially extending blades 151.

Figure 4:
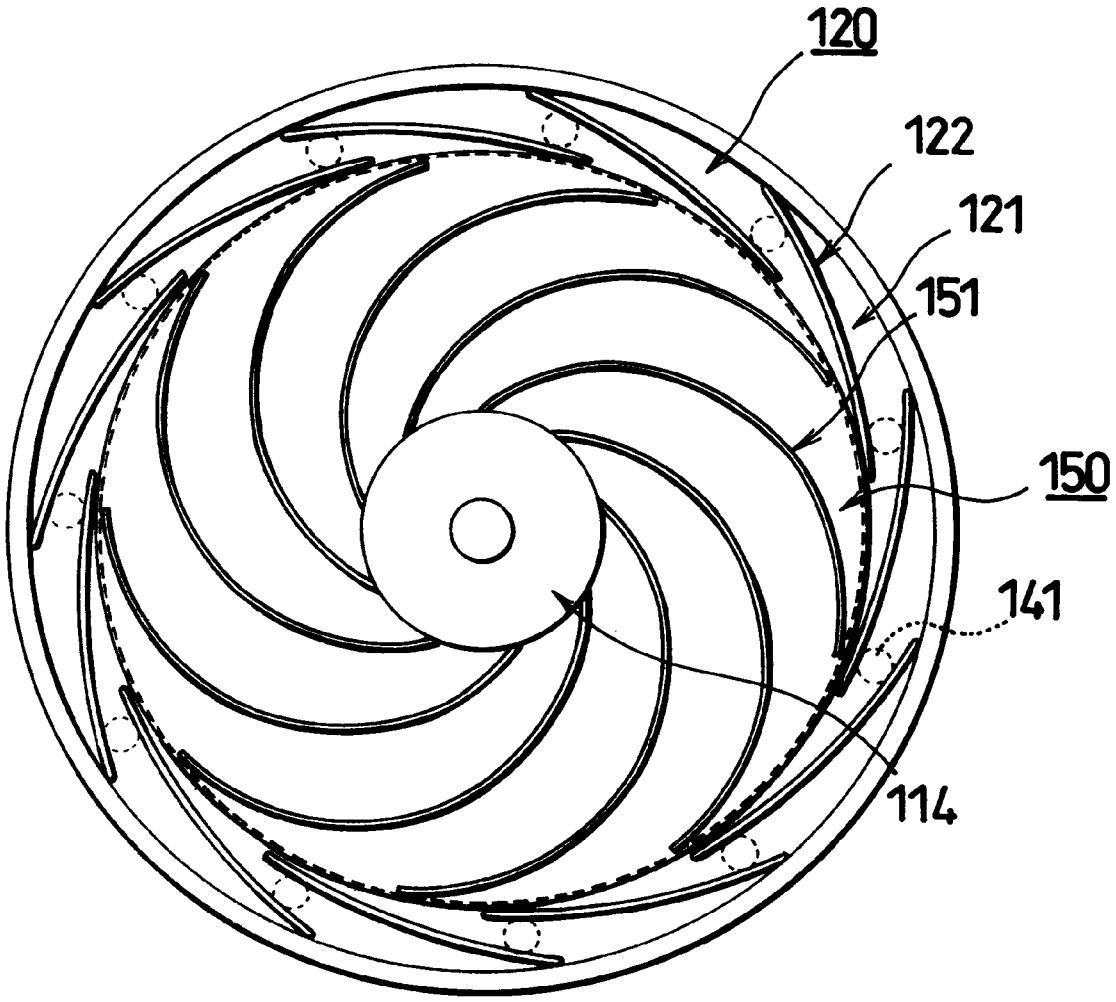
FIG. 4 is a top plan view of the electric fan of FIG. 3, with its fan case removed for illustration.

FIG. 4 shows a top plan view of the electric fan 100 with its fan case 130 removed. FIG. 4 also shows in phantom lines silencer cavities in the form of bores 141, which will be described in more detail later.

The diffuser 120 has on an upper side thereof a multiplicity of air guides 122 which extend radially outwardly and form, together with the fan case 130, air passages 121. On the lower side of the diffuser is an air return passage 123, as shown in FIG. 3.

The fan case 130 is made of, for example, a steel plate which is electroplated with zinc. The fan case is configured to cover the impeller 150 and sealingly mounted on the motor cover 111, so that the air flowing out of the air passages 121 is lead to the air return passage 123, which facilitates smooth and efficient flow of air through the vacuum cleaner.

Figure 5A:
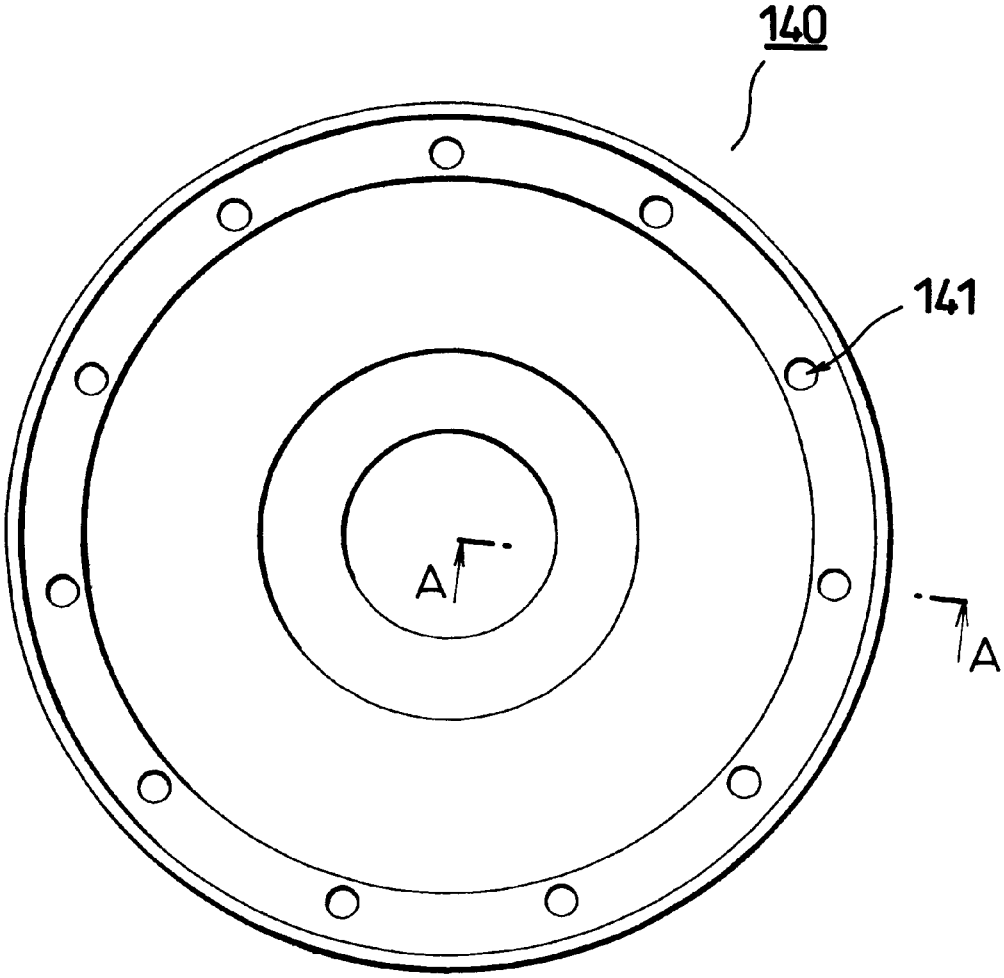
FIG. 5(*a*) is a bottom view of a silencer provided in the electric fan shown in FIG. 3, and FIG. 5(*b*) is a side view of the electric fan, partially cut along the line A—A of FIG. 5(*a*).
Figure 5B:
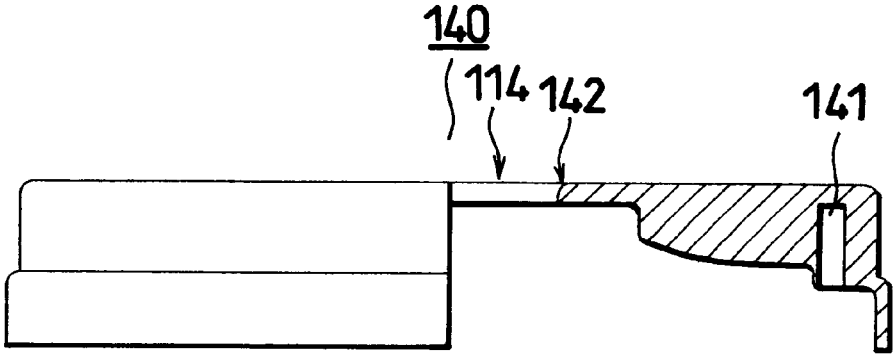

FIGS. 5(A) and 5(B) together show a structure of the silencer 140. It has a bottom configuration as shown in FIG. 5(A). FIG. 5(B) shows a fragmentary side view and a fragmentary cross section cut along a line A—A of FIG. 5(A).

As seen in these drawing figures, the silencer 140 is sealingly mounted on top of the fan case 130 such that each of the silencer bores 141 faces corresponding one of the air passages 121. It should be noted that the silencer bores are dead ended and each have a space of predetermined volume.

Figure 6:
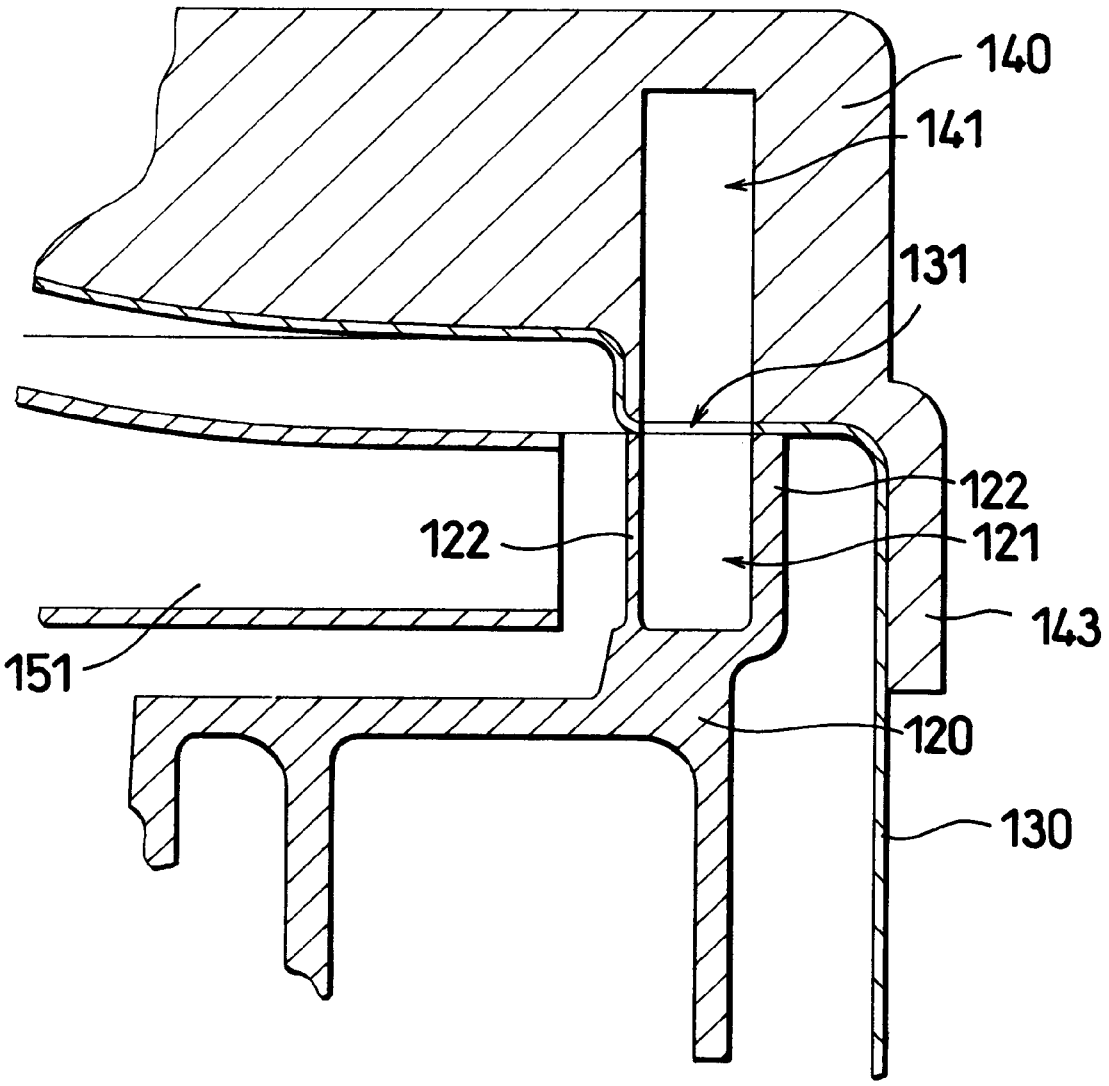
FIG. 6 is an enlarged fragmentary cross section of the electric fan, showing the relative arrangement of a silencer bore and an air passage associated with the silencer bore.

FIG. 6 shows in detail a relationship between a silencer bore 141 and the air passage 121 associated with the bore 141. It should be noted that each of the silencer bores 141 communicates at one end with the corresponding air passage 121 through a throughhole 131 formed in the fan case 130.

Referring back to FIG. 3, the silencer 140 has a flat surface on the proximate end thereof (as viewed from the opening 6) and a central air intake port 115 which is chamfered to facilitate a laminar flow of air through the air intake port 115.

When the vacuum cleaner is in operation, the blades 151 of the rotating impeller 150 expel the air trapped between them to the air passages 121, thereby evacuating an upstream region near the air intake port 115, which in turn causes suction of dusty air from a suction hose of the cleaner. The dusty air is cleaned by the filter 13 before it is taken into the air intake port 115.

The air expelled by the blades 151 of the impeller 150 interferes with the air passages 121. That is, the air forced by the impeller into the air passages 121 exhibits fluid friction with the air passages 121, generating NZ noise. It is known that the NZ noise has a peak frequency which is proportional to the product of the number N of the blades 151 and a rotational speed Z of the impeller 150, and that in order to suppress the NZ noise the silencer must have a volume determined by the peak frequency of the NZ noise.

In the example shown herein, the silencer 140 has silencer cavities or bores 141 for absorbing the NZ noise. It should be appreciated that the silencer 140 is tightly mounted on top of the fan case 130 such that each bore 141 has a volume proportional to the peak frequency of the NZ noise without affecting the structure of the air return passage 123. Consequently, the bores 141 may effectively annihilate the noise.

Figure 7:
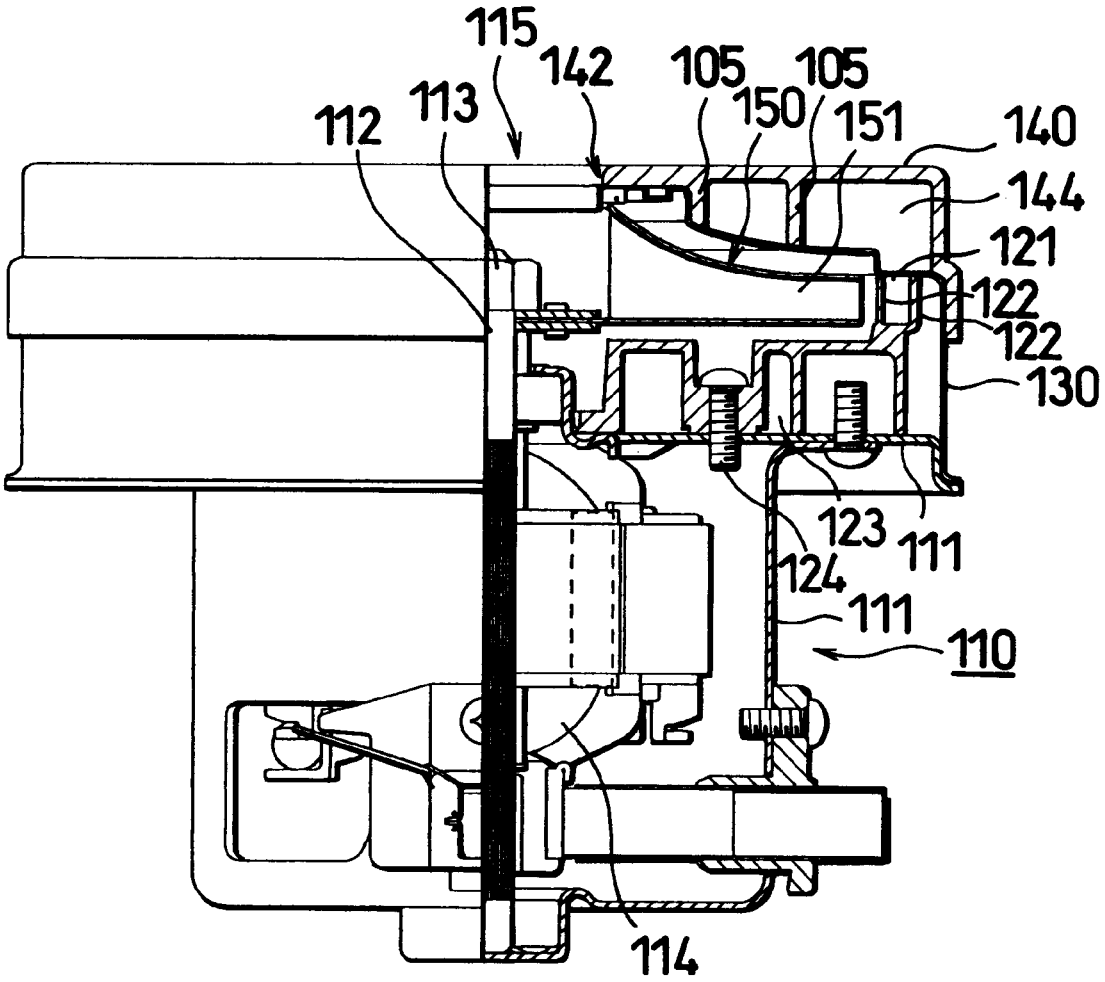
FIG. 7 shows a fragmentary cross section and a fragmentary side view of a second electric fan according to the invention.

Referring now to FIGS. 7 and 8, there is shown a second example of the electric fan embodying the invention.

In contrast to the first example where silencer consists of bores having a round cross section, the silencer of this example has a multiplicity of chambers which have generally rectangular cross sections and communicating with the air passages.

Figure 8A:
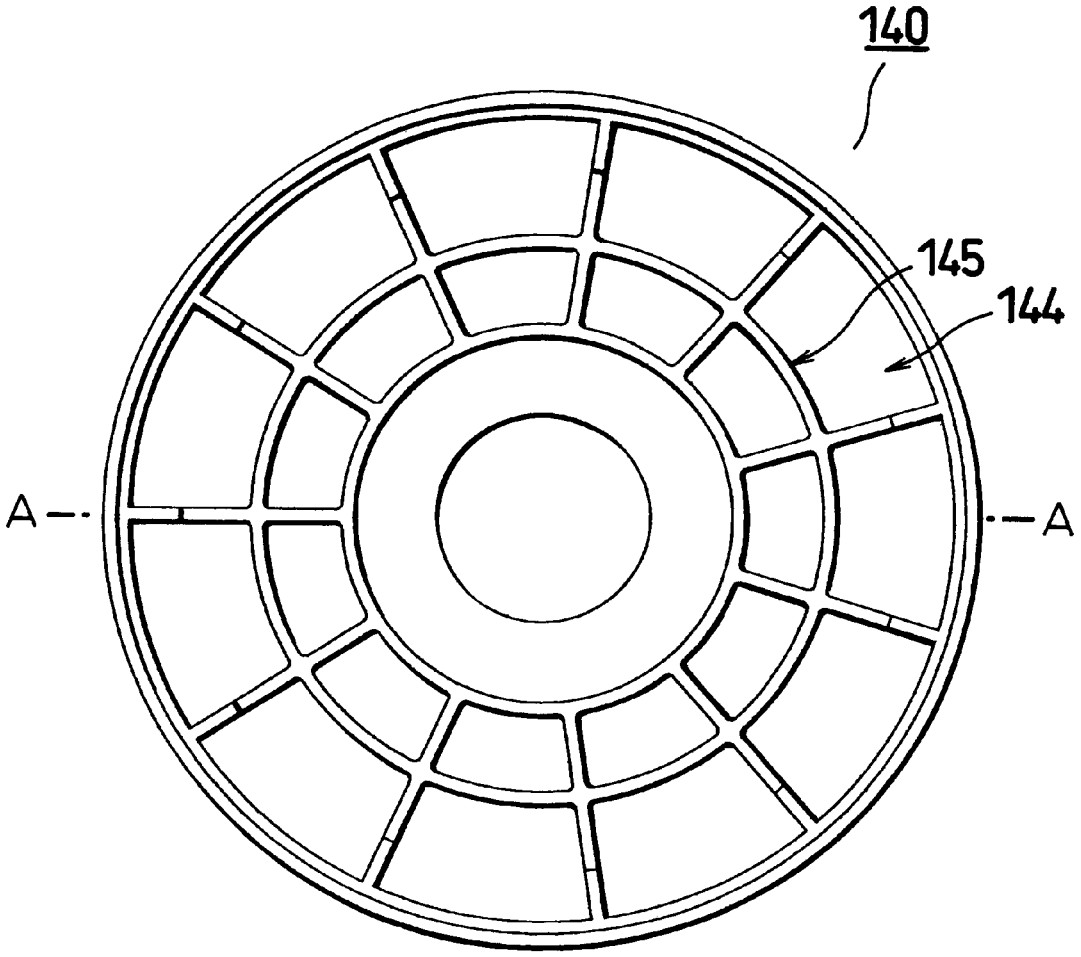
FIGS. 8(*a*) is a bottom view of a silencer provided in the electric fan shown in FIG. 7, and FIG. 8(*b*) is a fragmentary side view and a fragmentary cross section of the electric fan taken along a line A—A of FIG. 8(*a*).
Figure 8B:
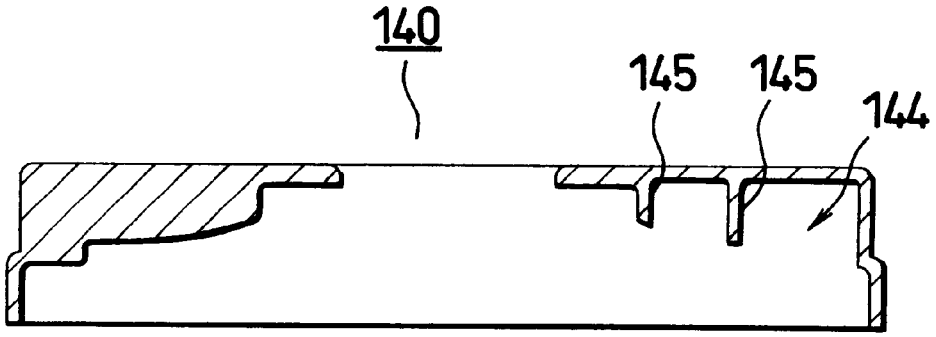
Figure 9A:
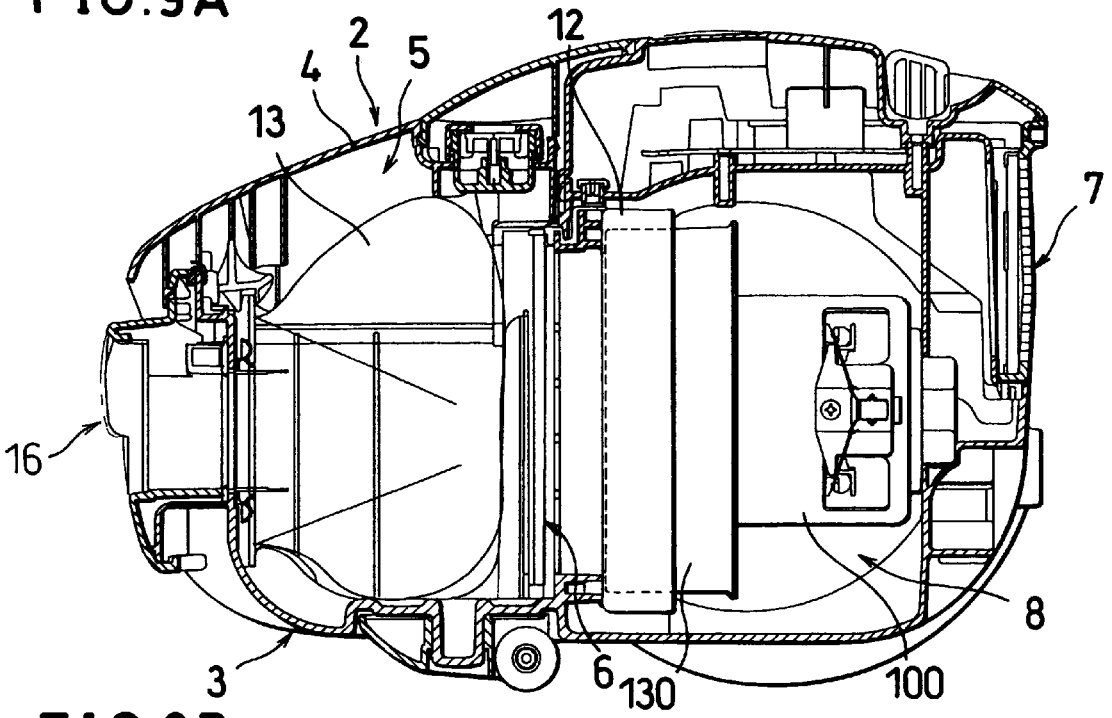
FIGS. 9(*a*) and 9(*b*). are a vertical cross section and a transverse cross section, respectively, of a vacuum cleaner equipped with a third electric fan according to the invention.
Figure 9B:
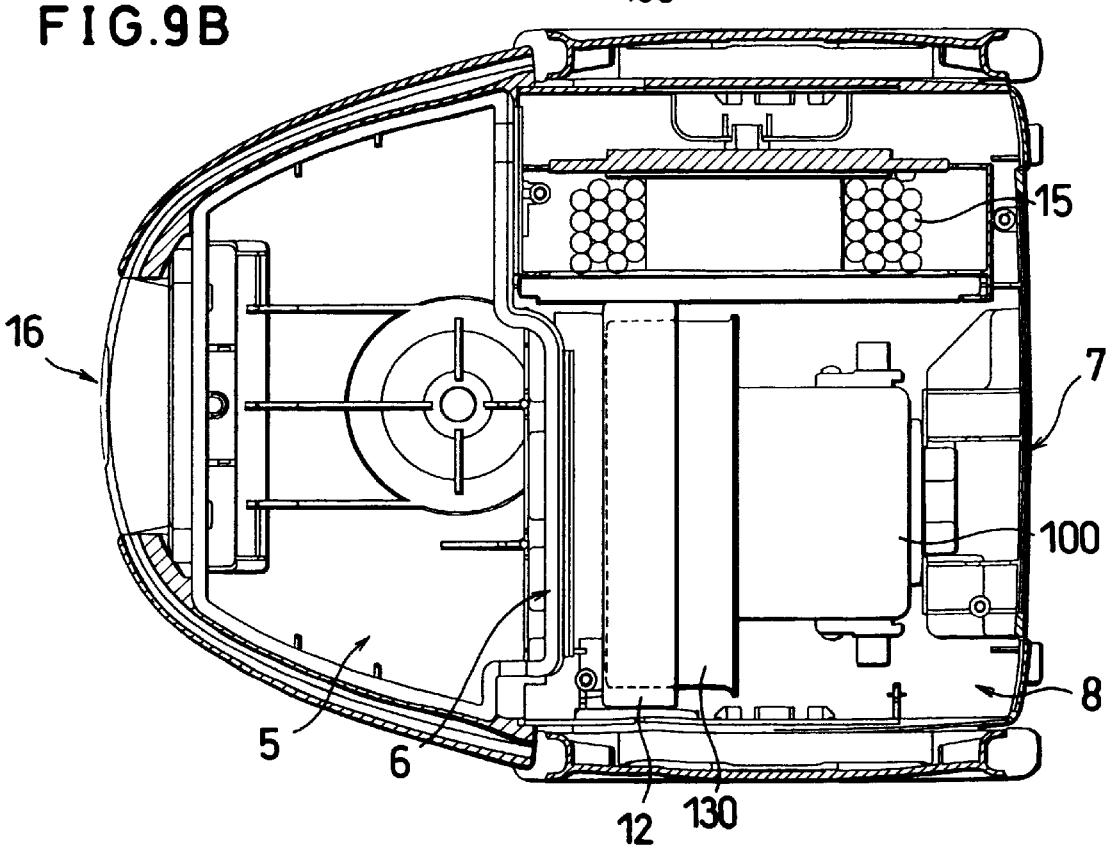
Figure 10:
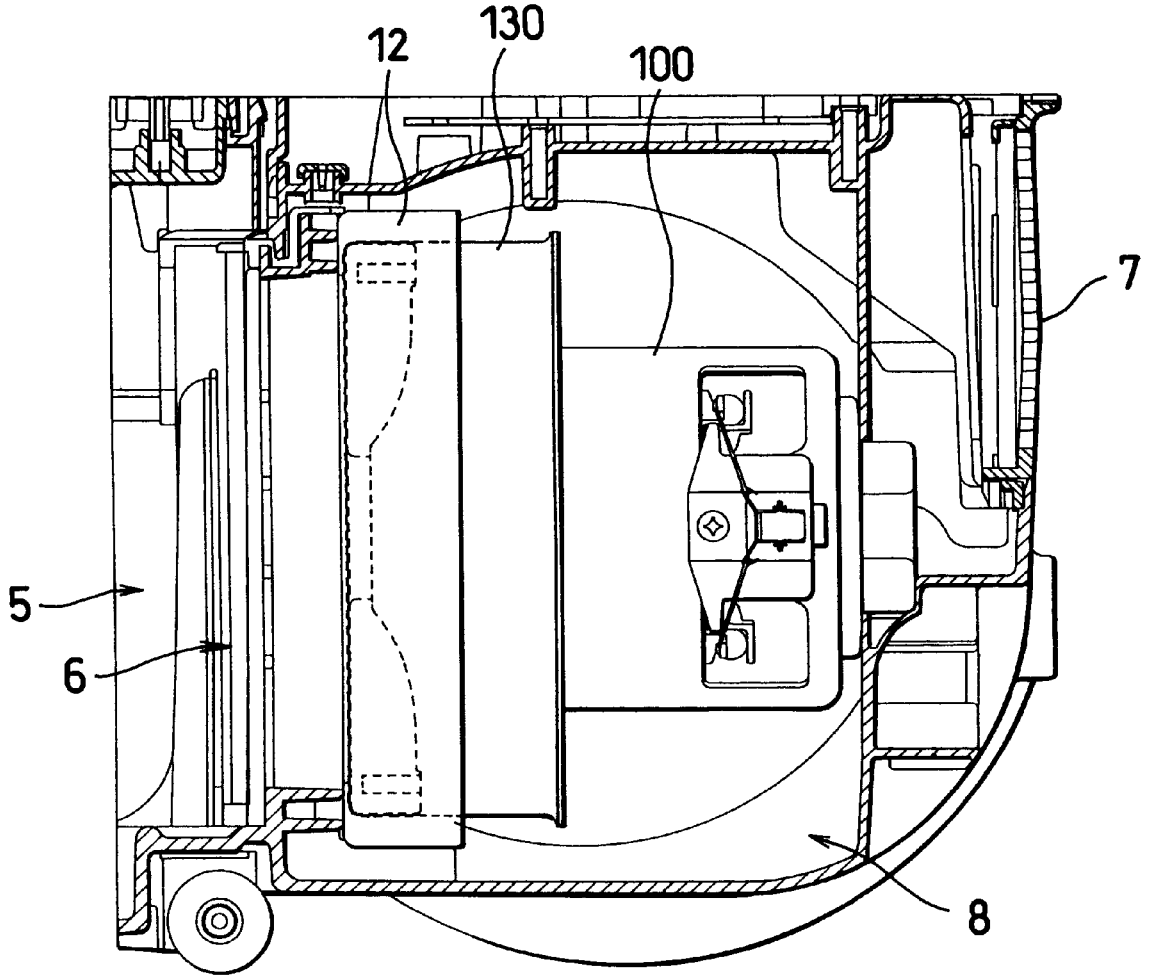
FIG. 10 is an enlarged fragmentary cross section of the electric fan of FIG. 9(*a*).
Figure 11:
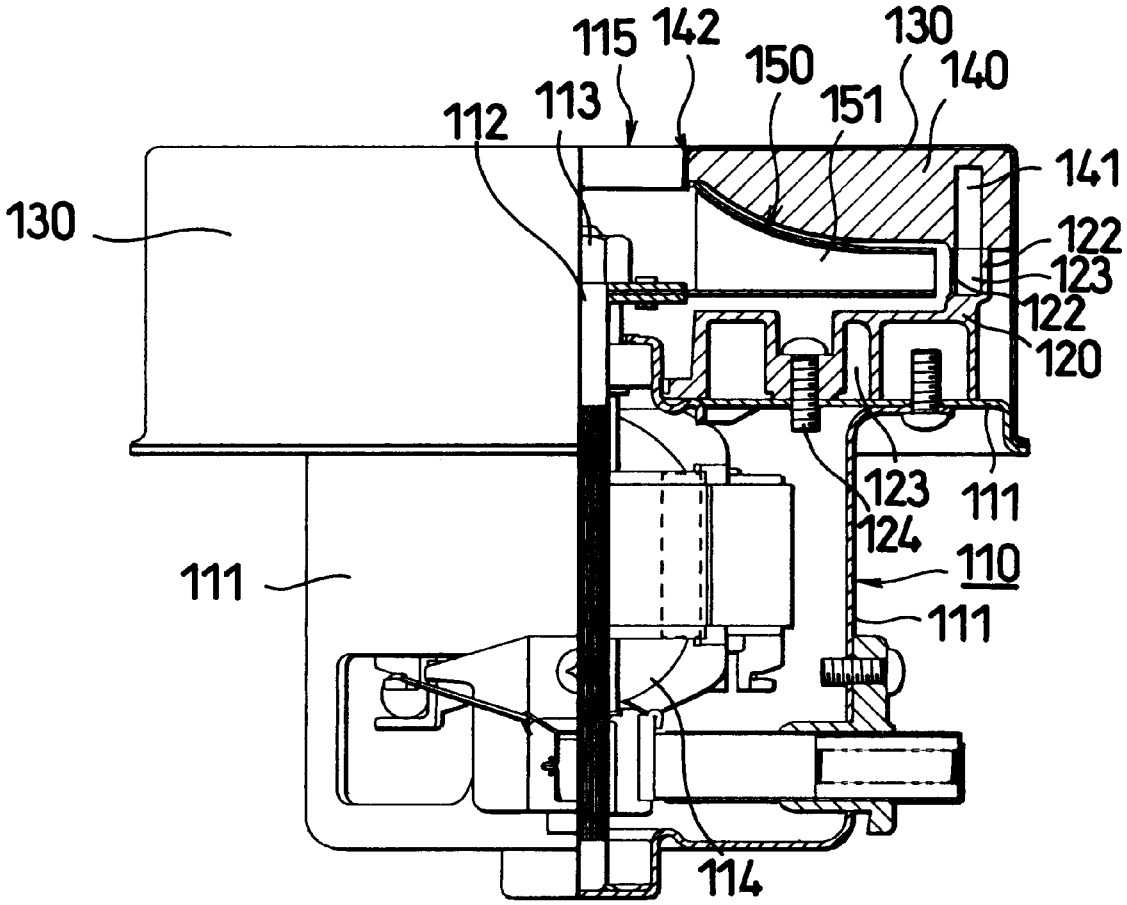
FIG. 11 is a fragmentary cross section of the electric fan of FIG. 10.

The structure of the electric fan 100 as described above is shown in FIGS. 7 in fragmentary cross section as well as in fragmentary side view. The silencer 140 of the electric fan is shown in FIG. 8 in bottom view (FIG. 8(A)) as well as in fragmentary side view (FIG. 8(B)). The cross section of the silencer is taken along line A—A of FIG. 8(A).

The silencer 140 has silencer chambers 144 partitioned by ribs 145. Each of the silencer chambers 144 communicates with a corresponding air passage 121 through a throughhole 131 formed in the fan case 130. It should be appreciated that these chambers can be constructed in arbitrary orientations and have sufficient volumes to effectively absorb the NZ noise generated.

The fact that each of the silencer chambers 144 of the silencer 140 may have an arbitrary volume implies that the even audible NZ noises may be sufficiently suppressed by choosing an appropriate volume for the silencer chambers, so that a calm electric fan may be designed. It would be recalled that if the entrance of an air intake port 115 is chamfered, it enhances a laminar airflow through it, thereby helping not only to reduce the noise, but also to improve the performance of the electric fan.

Referring now to FIGS. 9 through 13, there is shown a third example of the invention. This example differs from the first and the second examples in that the fan case 130 is adapted to cover the silencer 140.

Figure 12:
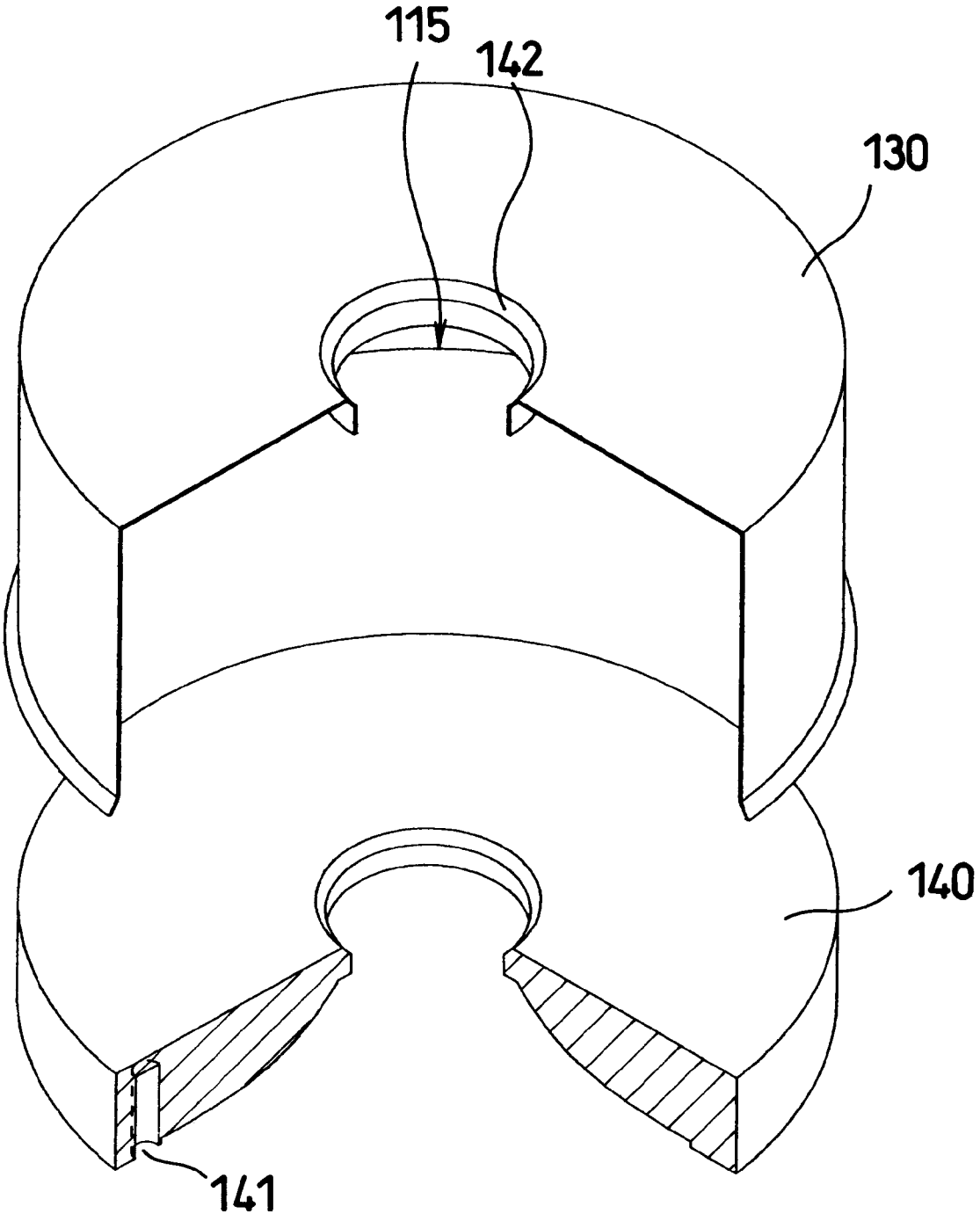
FIG. 12 is an exploded view of a silencer and a fan case therefor, partially cut away for illustration of their cross sections.
Figure 13:
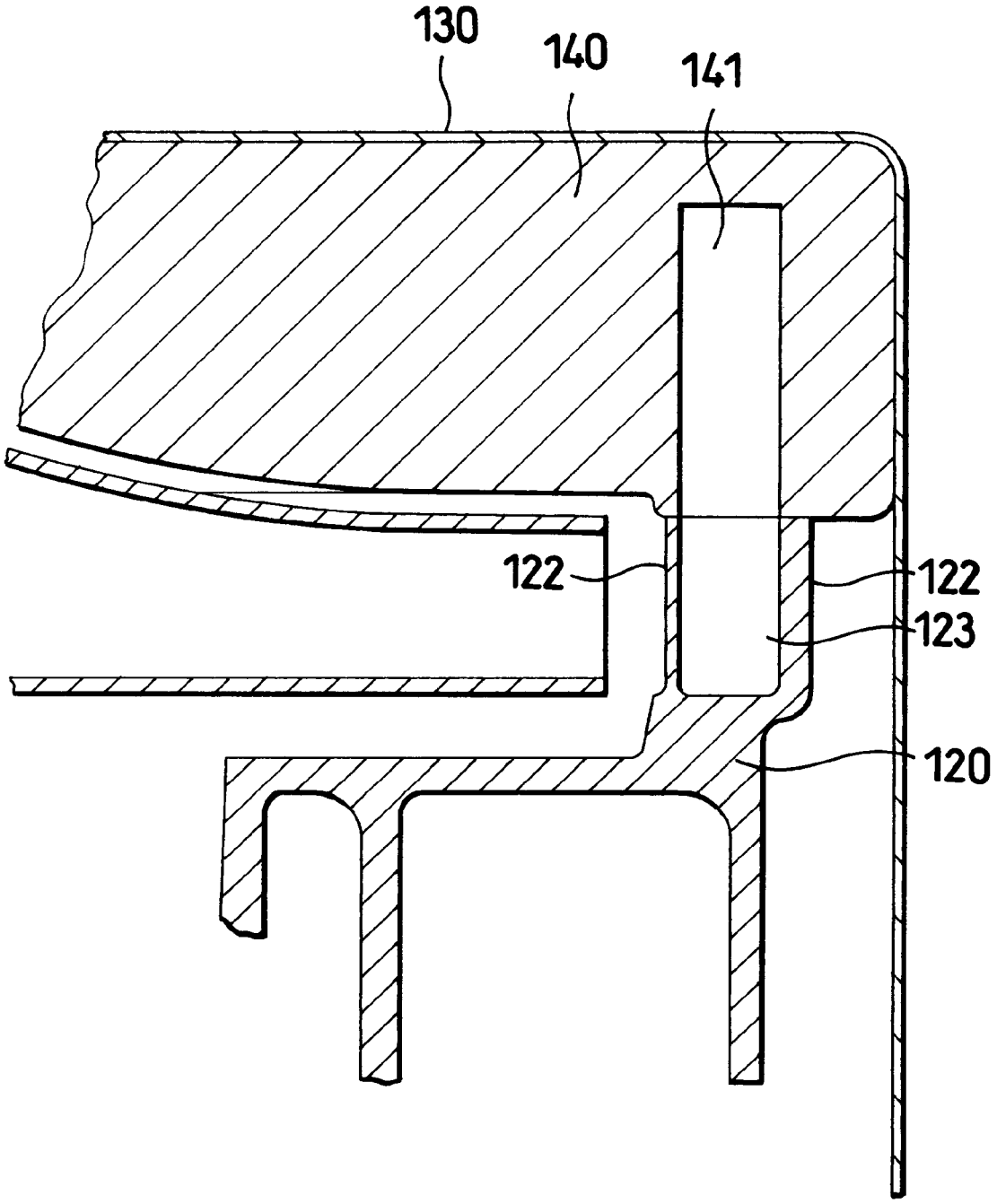
FIG. 13 is an enlarged fragmentary cross section of the electric fan, showing the relative arrangement of a silencer bore and an air passage associated therewith.

The difference would be well recognized by comparing FIGS. 12 and 13 with the corresponding FIGS. 3 and 6: the silencer 140 has silencer bores as in the first example, but the silencer is disposed in sealing contact with the inner wall of the fan case 130.

Figure 14:
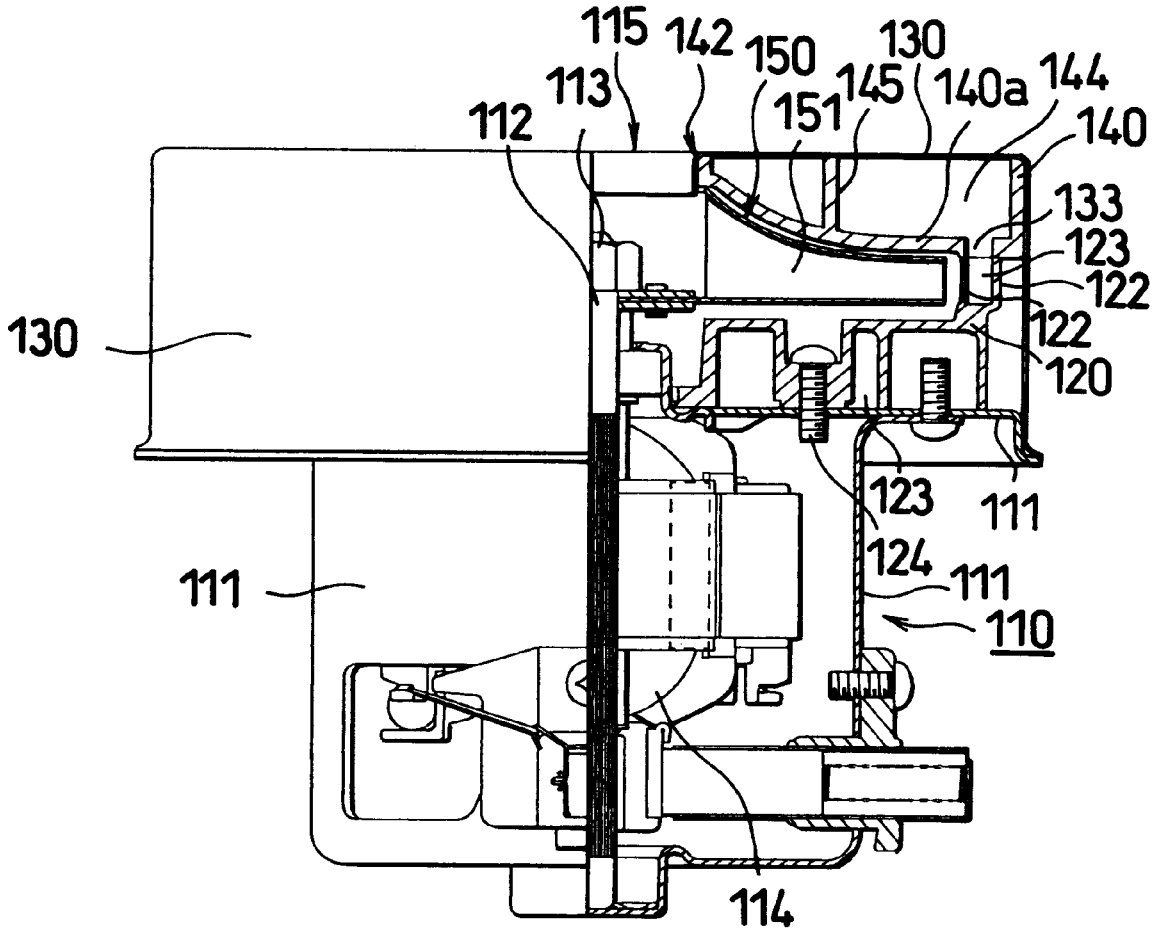
FIG. 14 is a fragmentary cross section of a fourth electric fan according to the invention.
Figure 15A:
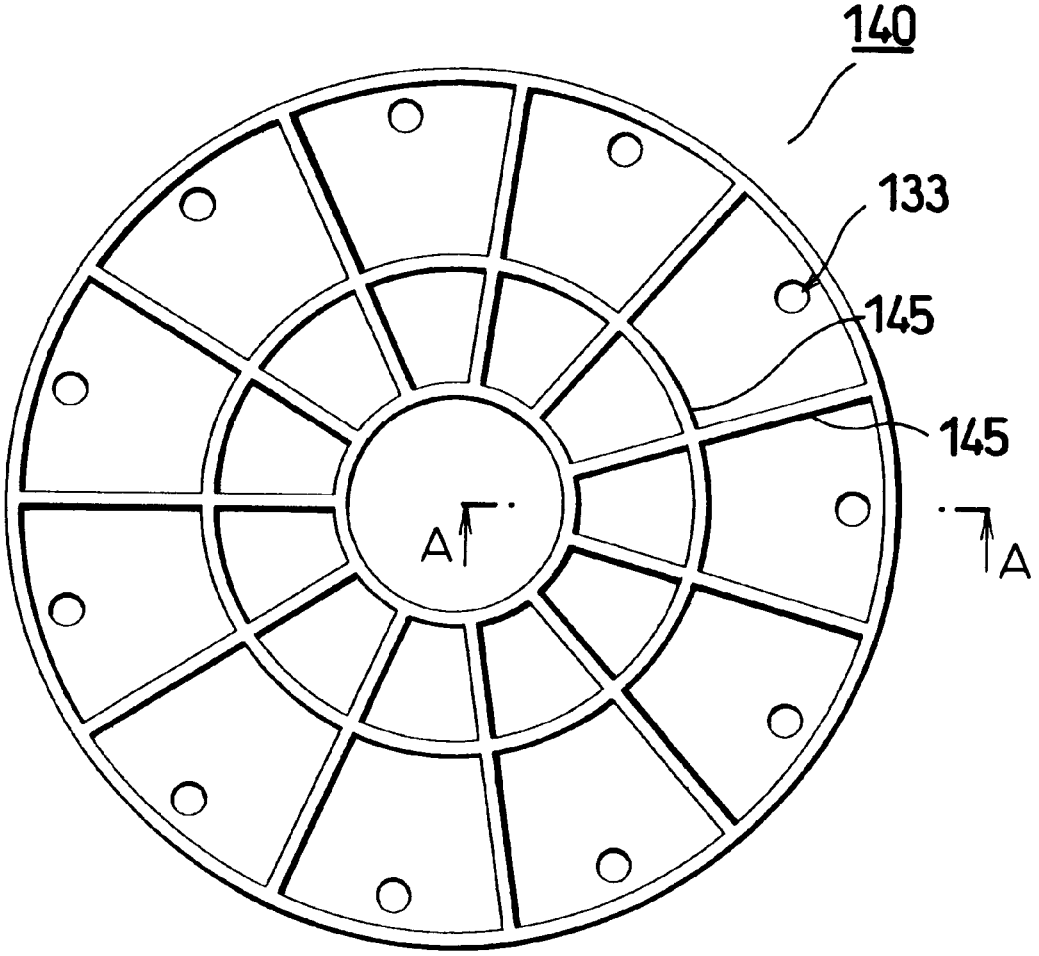
FIG. 15(*a*) is a bottom view of a silencer provided in the electric fan shown in FIG. 14, and FIG. 15(*b*) is a side view of the electric fan, partially cut in the direction of line A—A of FIG. 15(*a*).
Figure 15B:
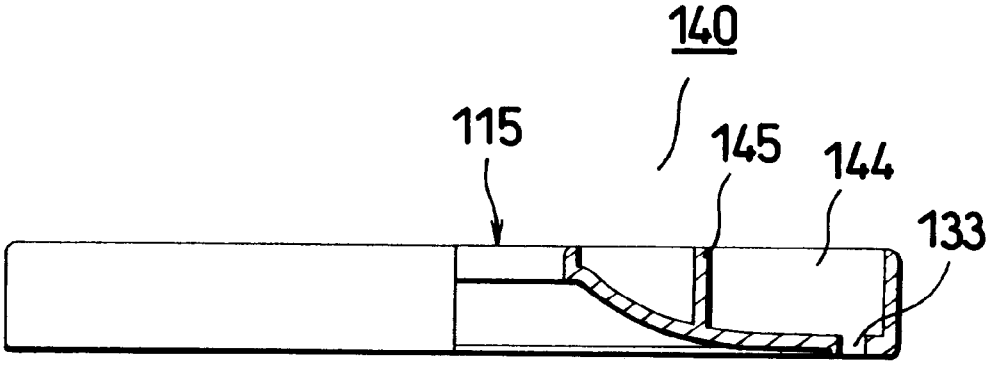
Figure 16:
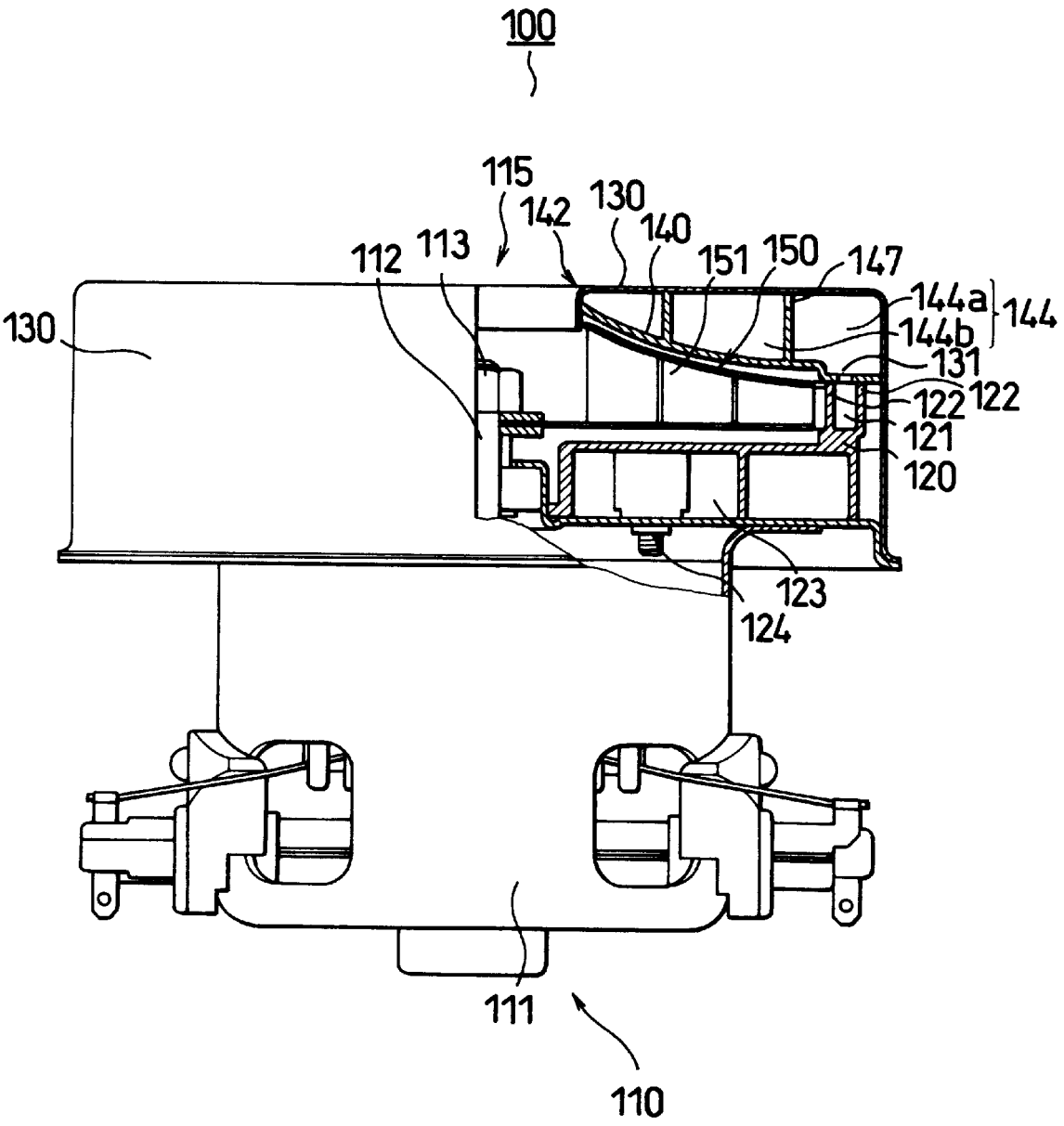
FIG. 16 is a fragmentary cross section of a fifth electric fan according to the invention.

Referring to FIGS. 14 and 15, there is shown a fourth example of the invention. The silencer 140 of this fourth example has silencer cavities in the form of chambers 144, which is similar to the silencer of the second example. However, the silencer is in sealing contact with the inner wall of the fan case 130, as will be understood by comparing FIGS. 14 and 15 with FIGS. 7 and 8. It should be noted, however, that in the fourth example the silencer chambers 144 are formed by lower walls 140*a* of the silencer extending along the envelope of the impeller 150 and by upper walls of the fan case 130. It would be apparent that the silencer chambers 144 have throughholes 133, allowing each of the silencer chambers 144 to communicate with a corresponding air passage 123.

In operation, the third electric fan as well as the fourth one operates in the same way as the first and the second examples. That is, in both the third and fourth electric fans, if the impeller 150 rotates, the blades 151 expel the air to the air passages 121, resulting in vacuum in the air intake port 115. This negative pressure in turn causes suction of dusty air from the suction hose. The dusty air is then filtered by the filter 13 and is liberated therefrom as clean air to the air intake port 115. The air expelled out of the blades 151 of the impeller 150 interferes with the air passages 121 to generate NZ noise which has a peak frequency proportional to the product of the number N of the blades 151 and the rotational frequency Z of the impeller. However, because of the silencer 140, the energy of the NZ noise is absorbed by the silencer bores 141 or by the silencer chambers 144, thereby annihilating the noise. Since any of these silencers 140 may be constructed independently of the air return passage 123, the volumes of the silencer bores 141 and the silencer chambers 144 can be made arbitrarily large, so that the silencer 140 may be adapted to annihilate NZ noise having any peak frequency.

Referring now to FIGS. 16 through 20, there is shown a fifth example of the invention. This example is similar to the fourth example, but differs from the fourth in that the silencer chamber 144 of the silencer 140 is partitioned by ribs 146*a* into a small chamber 144*a* and a large chamber 144*b*.

As in the fourth example, the motor unit 110 includes a motor cover 111 which has a diffuser 120 firmly secured on the motor cover by screws 124, and a motor shaft 112 which has a multiplicity of radially extending blades 151 firmly secured on the shaft by nuts 113. These blades constitute an impeller 150.

Figure 17:
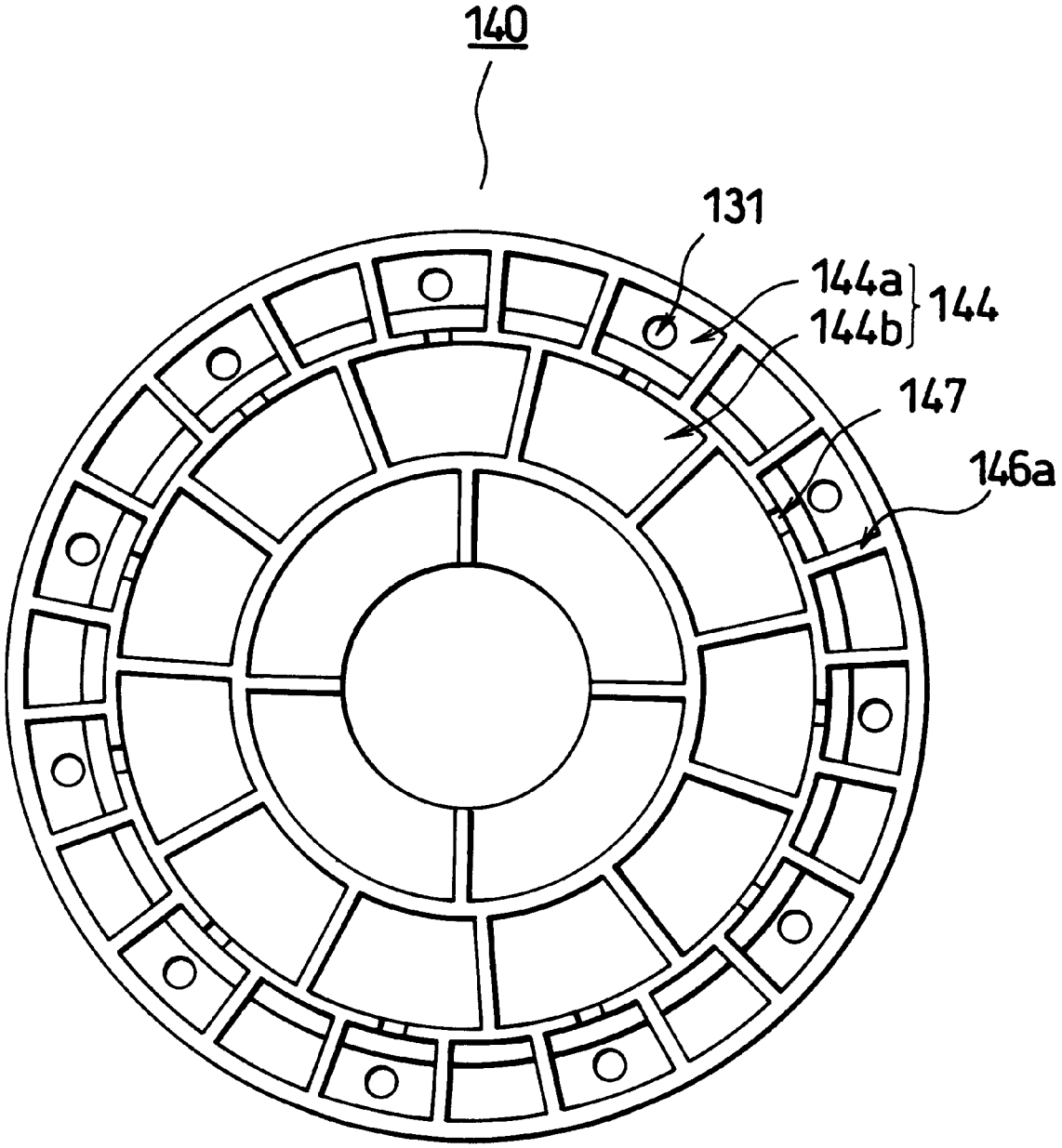
FIG. 17 is a top plan view of the silencer provided in the electric fan shown in FIG. 16.

FIG. 17 is the top plan view of the silencer 140, which is formed on the inner wall of the fan case 130. The small silencer chambers 144*a* and the large silencer chambers 144*b* are separated by ribs 146*a*. The small silencer chambers 144*a* are arranged along the periphery of the large silencer chambers 144*b*. A multiplicity of throughholes 131 are formed one in each small silencer chamber 144*a* such that the small silencer chamber communicates with one air passage 121 through the throughhole 131.

The ribs 146*a*, partitioning the silencer chambers 144*a* and 144*b*, are each provided with a cut 147 (FIG. 20) which enables the two silencer chambers communicate with each other.

Because of this structure, the silencer may suppress NZ noise of substantially all frequencies associated with different motor speeds, as follows. Since the frequency of the NZ noise is proportional to the motor speed, the frequency of the NZ noise changes when the rotational speed of the motor is changed to adjust suction power of the vacuum cleaner. Thus, in order to annihilate the NZ noise having variable frequency, there must be more than one silencer chamber having different volumes that correspond to the noise frequencies. It should be appreciated that the silencer of the fifth example includes a multiplicity of silencer chambers having different volumes to meet this requirement. For example, the silencer may be regarded to have a set of a small silencer chamber 144*a* and a large silencer chamber 144*b* communicating with the air passage 121 through the small chamber 141*a* and the cut 147. The volumes of these chambers are determined so as to annihilate NZ noise having the frequencies corresponding to the motor speeds.

Figure 18:
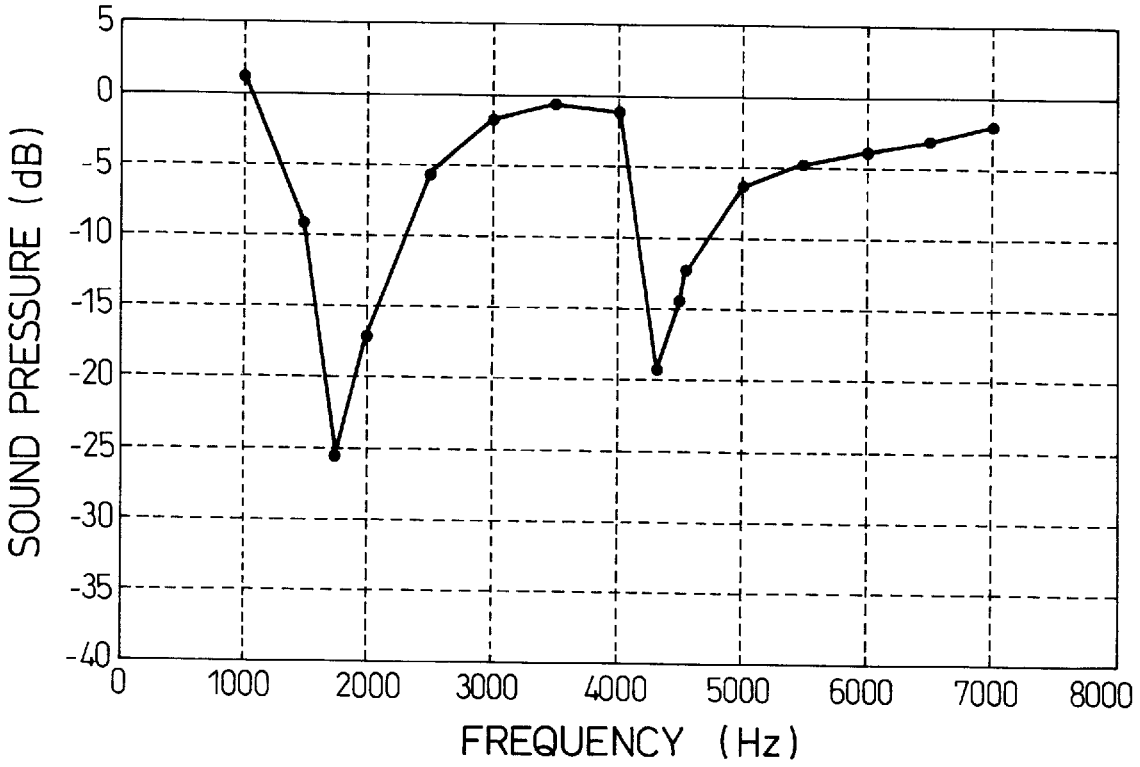
FIG. 18 is a graphical representation of a frequency analysis of the silencer having a small and a large silencer chambers, showing the effect of noise suppression in terms of sound pressure as a function of noise frequency.

FIG. 18 is a graphical representation of the frequency analysis of noise suppression effect obtained by the fifth silencer. It is noted that the sound pressure is suppressed to very low levels in a first frequency range from 1 to 2 kHz and in a second frequency range from 4 to 5 kHz. The suppression in the first range is due to small silencer chambers 144*a* and the second range due to the large silencer chambers 144*b*. Thus, as verified by the analysis, the silencer 140 may suppress NZ noise over different frequency ranges.

Figure 19:
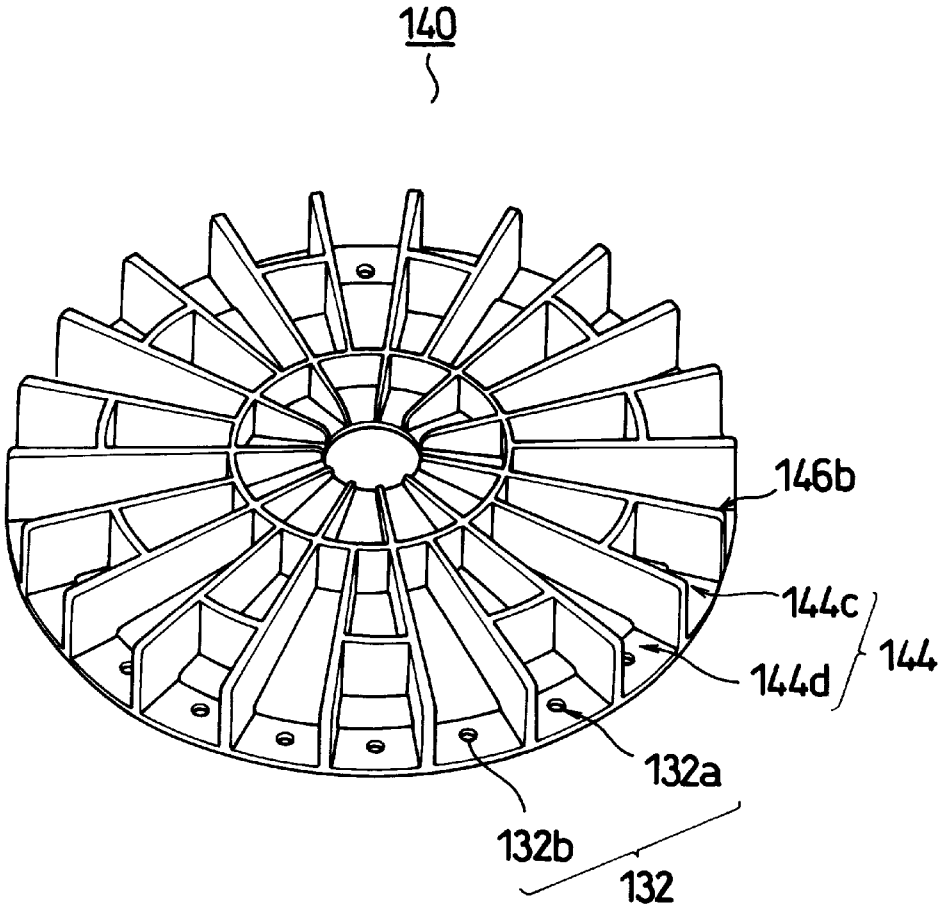
FIG. 19 is a perspective view of a silencer provided in the electric fan shown in FIG. 16.

It should be understood that, although the invention has been described herein for an example where one air passage 121 is provided with one throughhole 131 for communication with two small chambers 144*a* and 144*b*, the invention is not limited to the example. In fact each of the air passages 121 may be provided with two throughholes 132*a* and 132*b* for communication with two neighboring, but different sized, silencer chambers 144*c* and 144*d*, respectively, having two different volumes and constituting a silencer chamber 144, as shown in FIG. 19.

Figure 20:
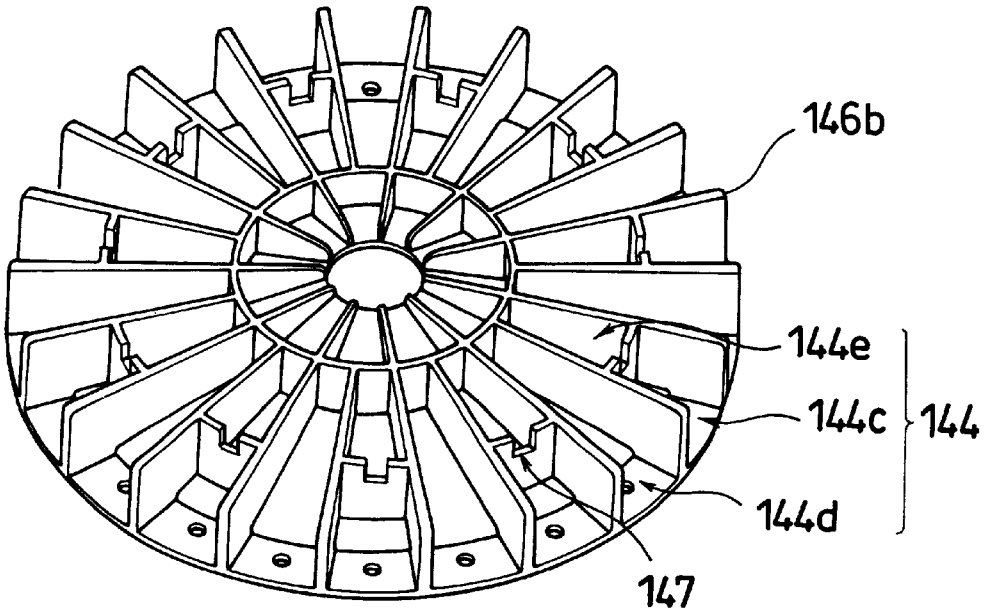
FIG. 20 is a perspective view of another silencer provided in the electric fan shown in FIG. 16.

In addition, these neighboring silencer chambers 144*c* and 144*d* may be connected through a cut 147 formed in the partition between them. Then the silencer 140 is constituted by a small silencer chamber 144*e*, an intermediate chamber 144*c*, and a large chamber 144*d*, as shown in FIG. 20.

Figure 21:
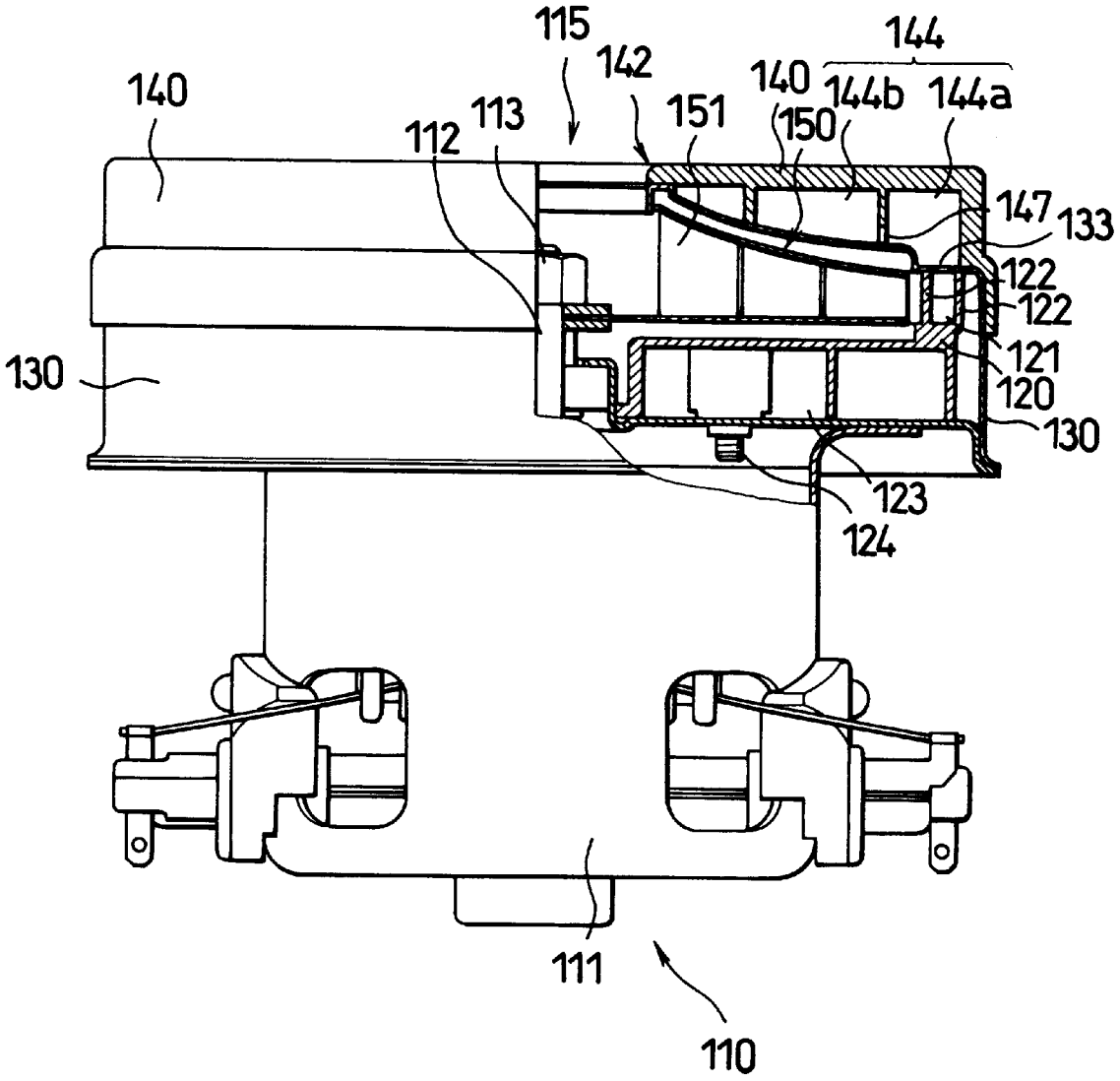
FIG. 21 is a fragmentary cross section of a sixth electric fan according to the invention.
Figure 22:
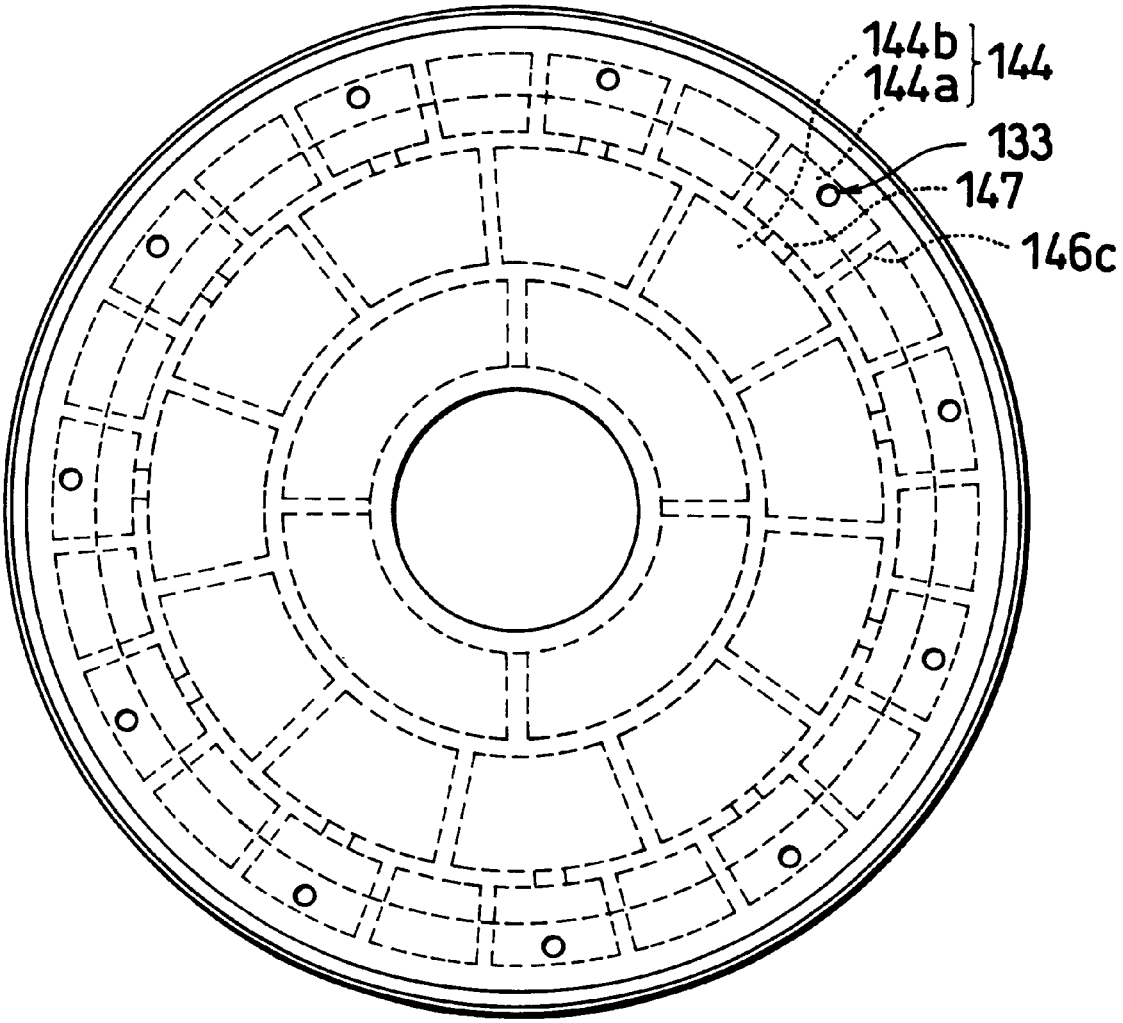
FIG. 22 is a top plan view of a silencer provided in the electric fan shown in FIG. 21.
Figure 23:
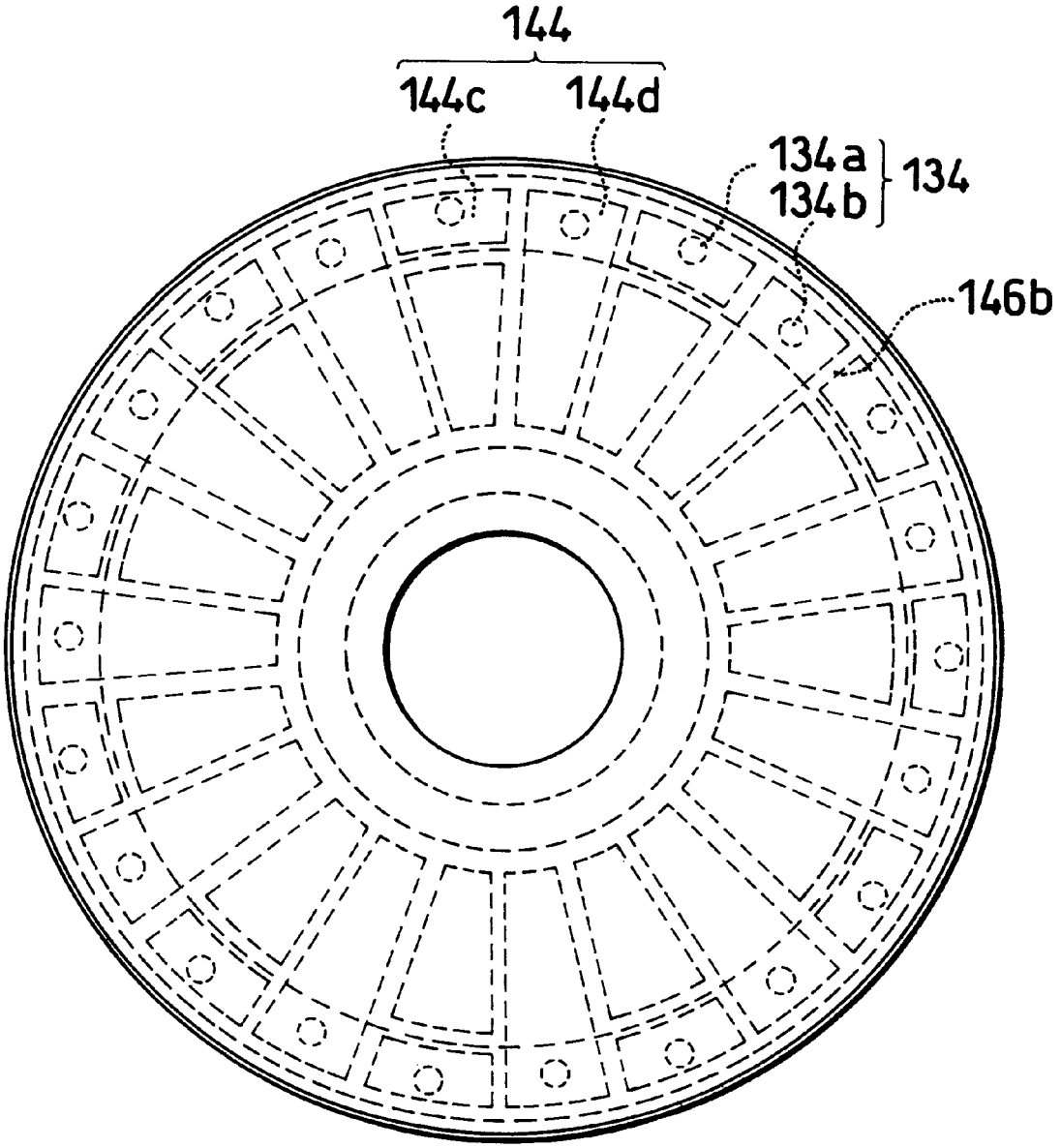
FIG. 23 is a top plan view of another silencer provided in the electric fan shown in FIG. 21.
Figure 24:
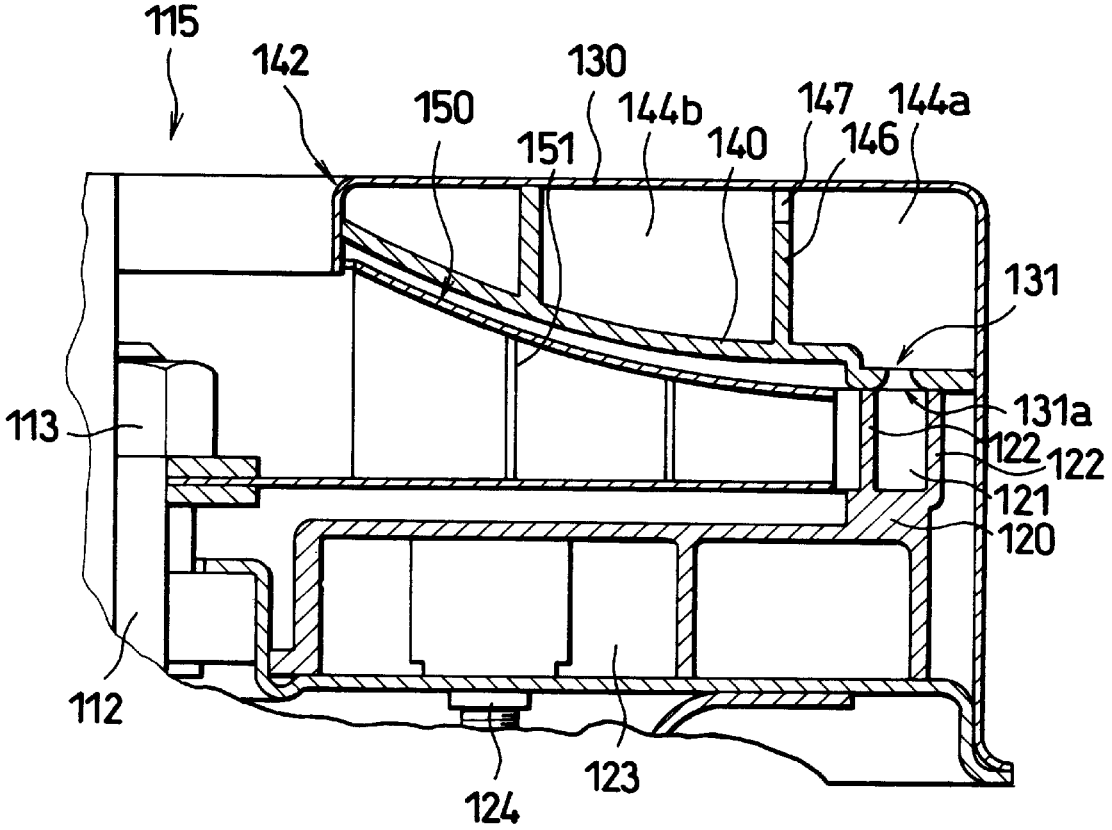
FIG. 24 is a fragmentary cross section of a seventh electric fan according to the invention, showing in detail the configuration of an cavity suppressor.

Referring now to FIGS. 21 through 23, there is shown a sixth example of the invention, which is similar to the second one, but differs therefrom in that the silencer chamber 144 of this example is, like fifth example, provided with a small and a large silencer chambers 144*a* and 144*b*, respectively, as shown in FIGS. 21 and 22, and that the two chambers 144*a* and 144*b* are communicated with each other through a cut 147 formed in the rib 146*c* between them. The cut 147 is formed on the edge of the partition which is in contact with the fan case 130., as shown in FIG. 21. The small chamber 144*a* communicates with the air passage 121 through the throughhole 133. Thus, the air passage is communicated with the small silencer chamber 144*a* as well as the larger silence chamber 144*b*.

Consequently, the silencer may effectively annihilate NZ noise having a frequency associated with the small silencer chamber 144*a* as well as the noise associated with the large silencer chamber 144*b*. It is advantageous to provide the throughhole 133 in the small silencer chamber 144*a* rather than in the large silencer chamber 144*b*.

Although the fifth example has been described for a case where each of the air passage 121 is provided with one throughhole 133 for communication with one small silencer chamber 144*a*, and the small silencer chamber 144*a* is further communicated with a neighboring large silencer chamber 144*a* by a cut 147, the invention will not be limited to the details of the example. In fact, as shown in FIG. 23, the silencer 140 may be modified to include two throughholes 134*a* and 134*b* for each air passage 121 with one throughhole for a small chamber 144*c* and another throughhole for a large chamber 144*d*. In addition a cut may be formed in the rib 146*b* between the two radially neighboring chambers, thereby providing three silencer chambers having different volumes, as in the example shown in FIG. 20. It would be apparent to those skilled in the art that the number and the volumes of such silencer chambers can be arbitrarily determined in accordance with the modes of the NZ noise generated by the impeller.

Referring now to FIGS. 24 through 27, there is shown a seventh example which is similar to the fifth example. However, this example differs from the fifth in that the edge of the throughhole 131 between the silencer chambers 144 and the air passage 121 is chamfered in the bell-shape 131*a*. The throughhole 131 is bell-shaped because otherwise the airflow in the air passage 121 is likely to be disturbed by the throughhole 131 and gives rise to turbulence in the neighborhood of the hose, which in turn generates cavities or rapid imbalances in pressure between the air passage 121 and the small silencer chamber 144*a* and resultant noise called cavity noise.

By the chamfered throughhole 131, the air passage 121 is smoothly connected with the small silencer chamber, so that the pressure imbalance between the small silencer chamber and the air passage is well moderated, thereby preventing occurrence of the turbulence and the cavity noise. In this sense the chamfer 131*a* serves as a means for suppressing cavities, and will be hereinafter referred to as cavity suppressor. It should be appreciated that the cavity suppressor helps to improve the efficiency (or cleaning power) of the vacuum cleaner, since the cavity suppressor minimizes the turbulence in the air passage.

Figure 25:
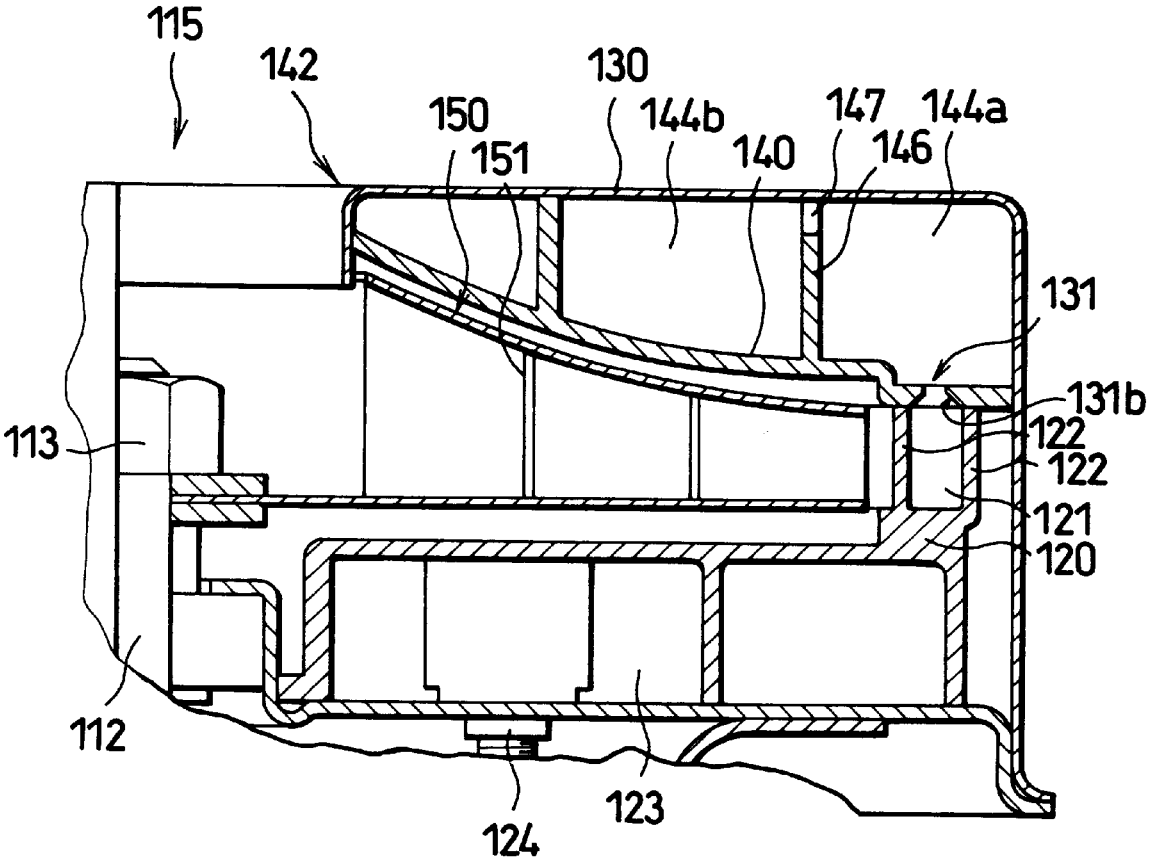
FIG. 25 is an enlarged fragmentary cross section of another cavity suppressor provided in the electric fan of FIG. 24.
Figure 26:
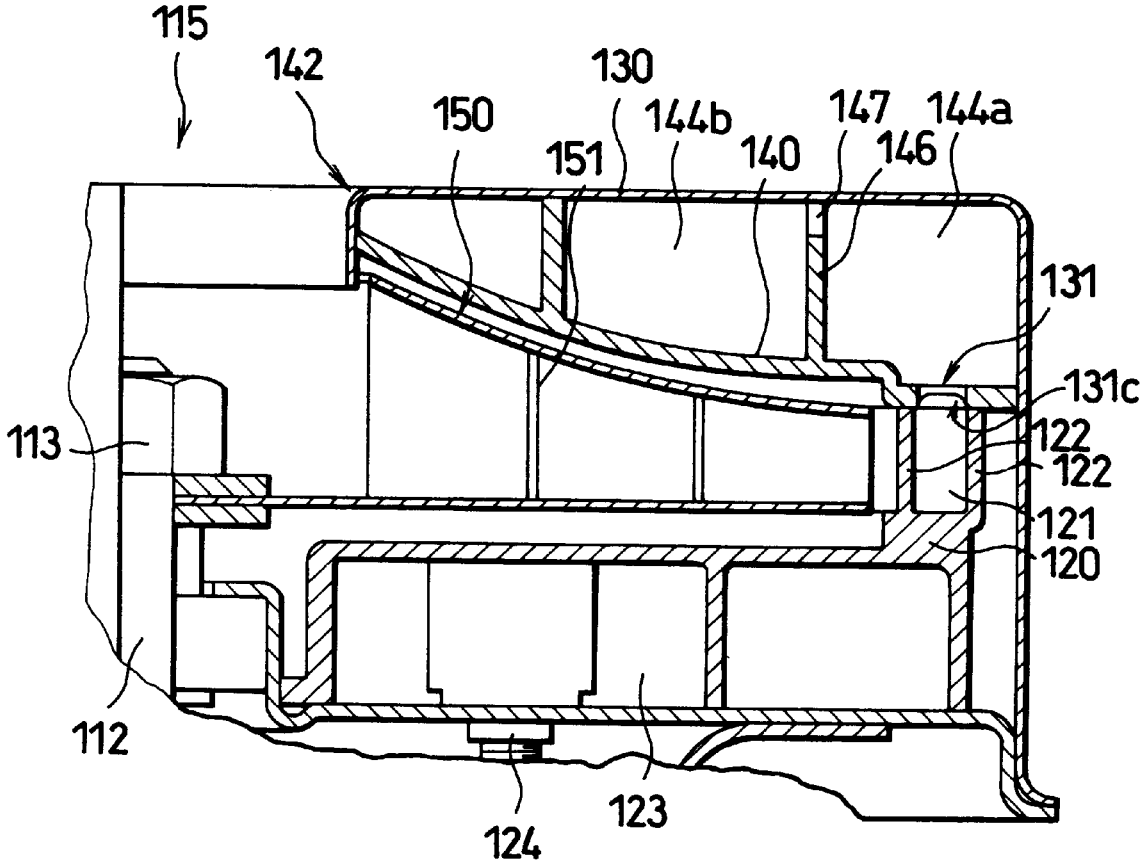
FIG. 26 is an enlarged fragmentary cross section of still another interference suppressor provided in the electric fan of FIG. 24.
Figure 27A:
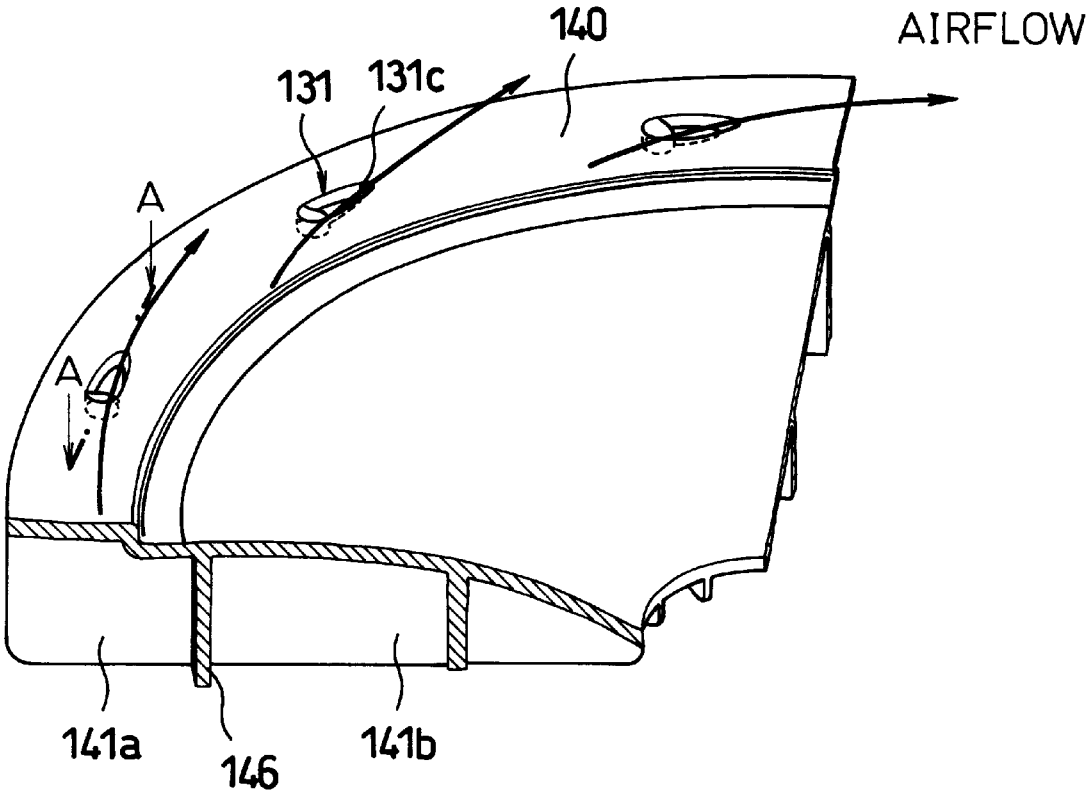
FIG. 27(*a*) is a fragmentary perspective view of a silencer having the cavity suppressor of FIG. 26, and FIG. 27(*b*) is an enlarged fragmentary view of the cavity suppressor.
Figure 27B:
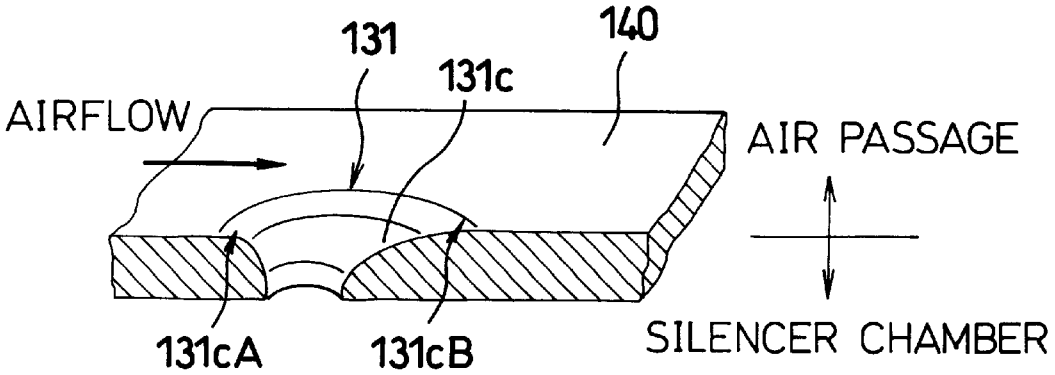
Figure 28:
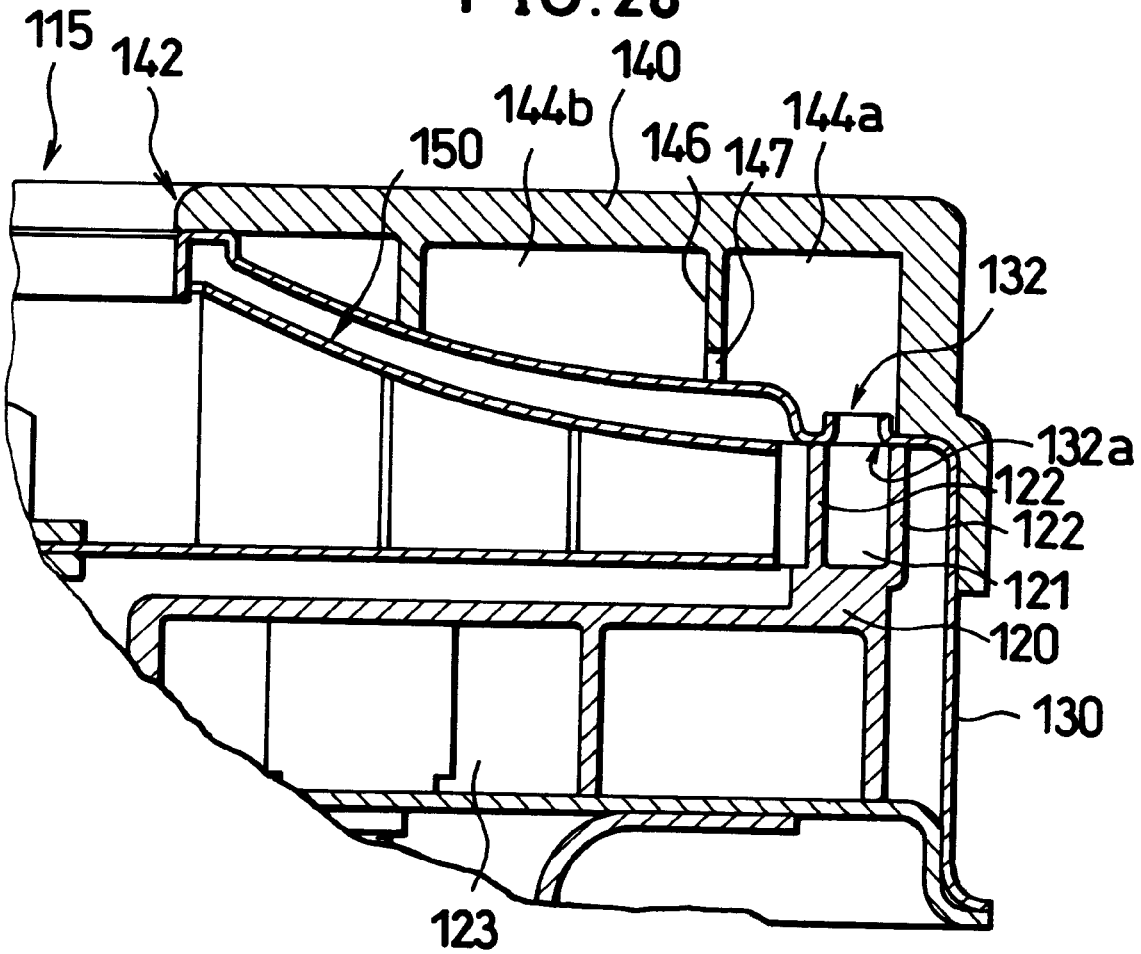
FIG. 28 is an enlarged cross section of a fan case of an eighth electric fan, equipped with an cavity suppressor.

It should be understood that the configuration of the chamfer 131*a* is not limited to a bell-shape. It can be any shape so long as it may gradually decrease the pressure difference across the throughhole 131. For example, as shown in FIG. 25, the chamfer may be replaced by a taper having a larger opening towards the air passage 121. The throughhole 131*a* may be alternatively provided with a throughhole having a stream line mouth and merging smoothly to the air passage, as shown in FIGS. 26 and 27. FIG. 27(*a*) shows a fragmentary perspective view of the silencer 140 as viewed from the air passage 121. FIG. 27(*b*) is a cross section taken along the line between the two arrows A. As seen in the figure, the throughhole 131*c* extends longer in the direction indicated by the dotted arrows in FIG. 27.

Referring now to FIGS. 28 through 33, there is shown an eighth example, which is similar in structure to the sixth as described previously. However, this example is different from the sixth in that a cavity suppressor 132*a* is formed on a throughhole 132 of the fan case 130 by smoothly bending the edge of the throughhole 132 towards the silencer chamber 144.

This cavity suppressor 132*a* is also capable of preventing or suppressing turbulence of the airflow in the air passage, thereby preventing the cavity noise and improving the efficiency of the electric fan.

Figure 29:
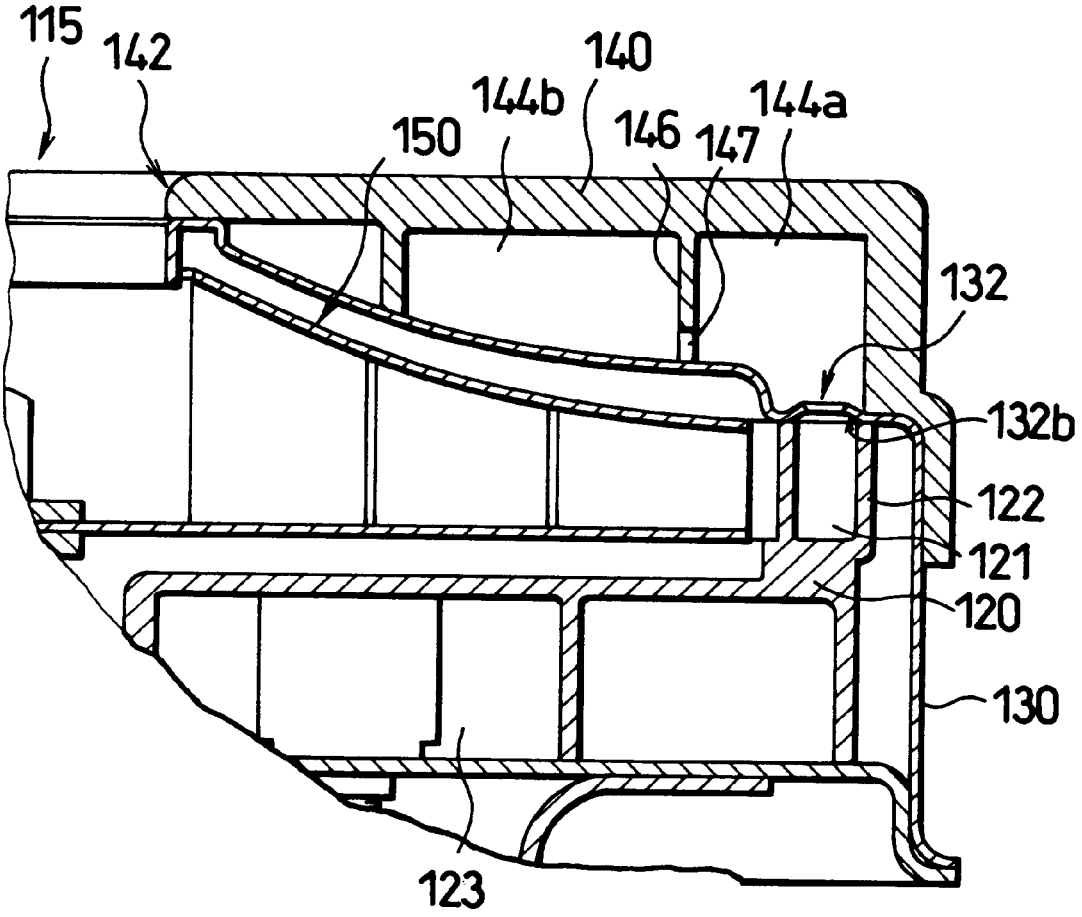
FIG. 29 is an enlarged fragmentary cross section of another cavity suppressor provided in the electric fan of FIG. 28.

It would be understood that the cavity suppressor 132*b* can be of any other alternative shape. For example, it may be a semi-spherical recess 133*b* formed in the fan case 130, which is recessed towards the silencer chamber 144 and having a throughhole through it, as shown in FIG. 29. Such semi-spherical cavity suppressor 133*b* may relieve rapid pressure imbalances across it, thereby preventing the cavity noise.

Figure 30:
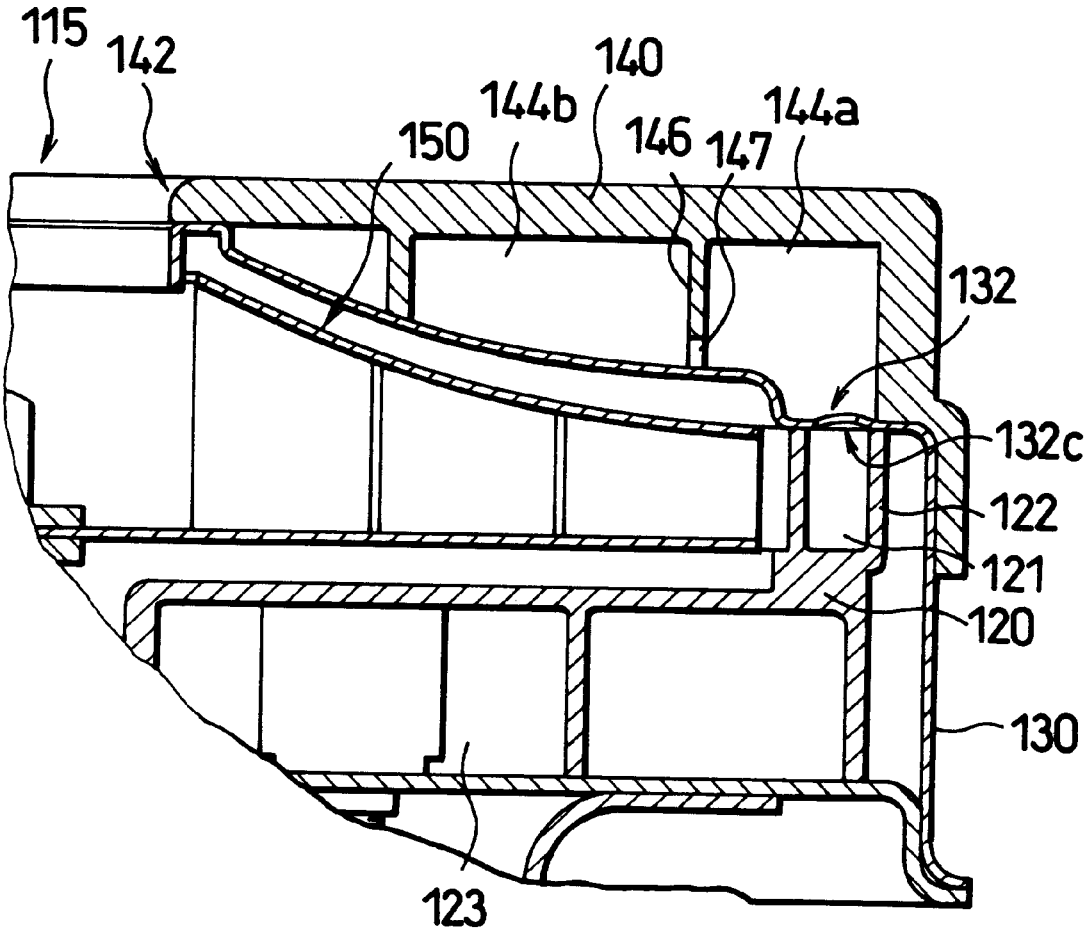
FIG. 30 is an enlarged fragmentary cross section of still another cavity suppressor provided in the electric fan of FIG. 28.
Figure 31A:
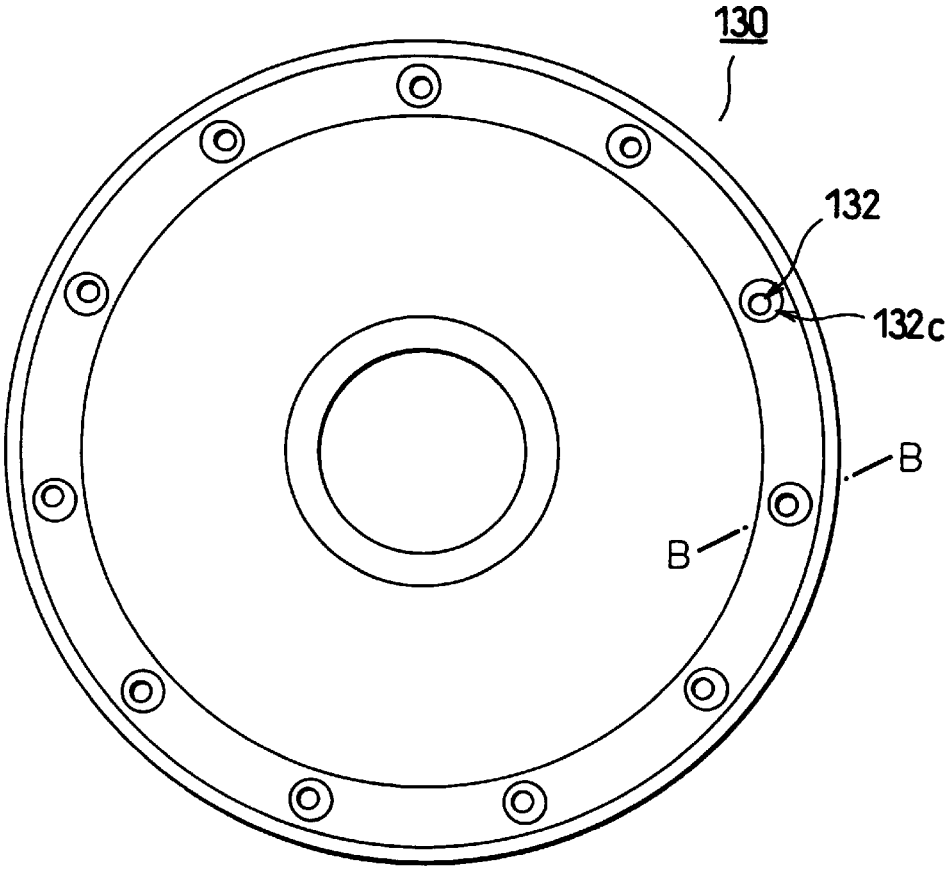
FIG. 31(*a*) is a top plan view of a fan case having the cavity suppressor of FIG. 30, and FIG. 31(*b*) is a cross section taken along a line B—B of FIG. 31(*a*).
Figure 31B:
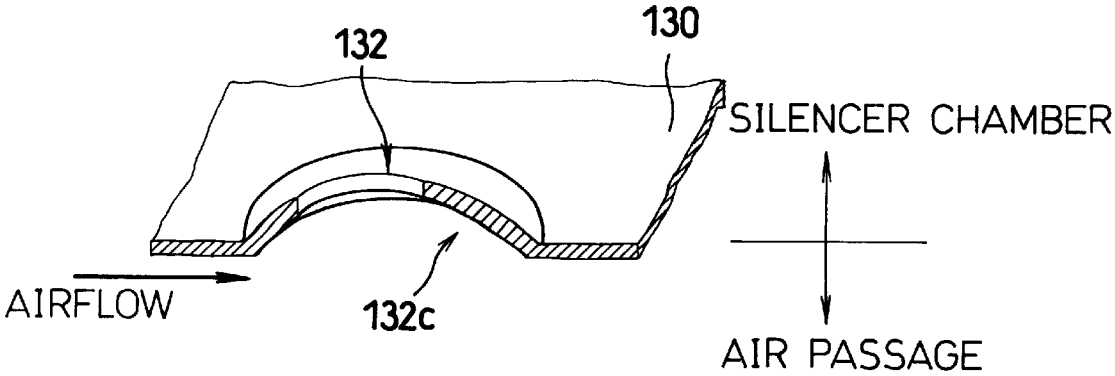

In providing the throughhole 132 in the cavity suppressor 132*c*, it may be provided at a location away from the center of the cavity suppressor 132*c* and towards the upstream of the airflow, as discussed below and shown in FIG. 30 and in more detail in FIG. 31. An example of such throughhole 132 is shown in a top plan view, FIG. 31(*a*) of the fan case 130. FIG. 31(*b*) shows a cross section of the throughhole 132 taken in the direction of arrows B of FIG. 31(*a*), which is the direction of the airflow in the air passage.

The reason why the throughhole 132 is shifted towards the upstream of the airflow is that it may then effectively prevent turbulence from growing behind the throughhole 132, so that this arrangement further contributes to suppression of the cavity noise.

Figure 32:
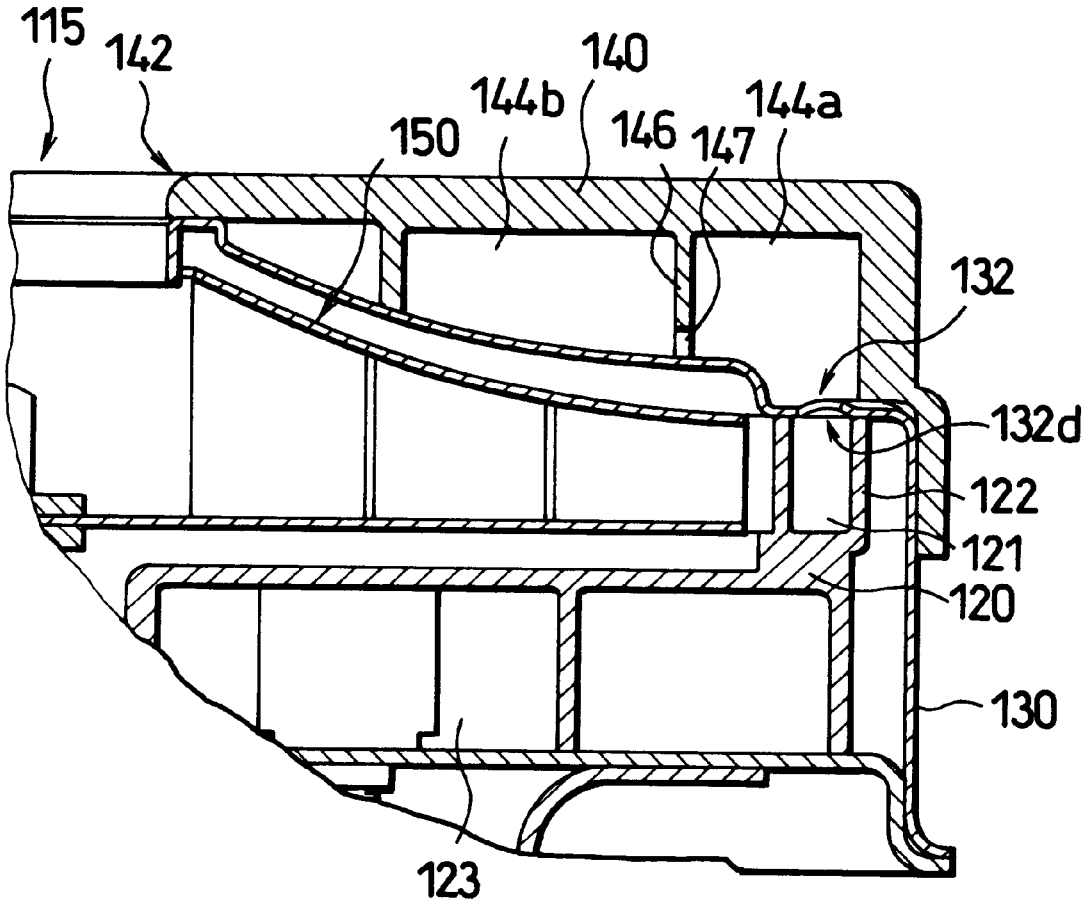
FIG. 32 is an enlarged fragmentary cross section of still another cavity suppressor provided in the electric fan of FIG. 28.
Figure 33:
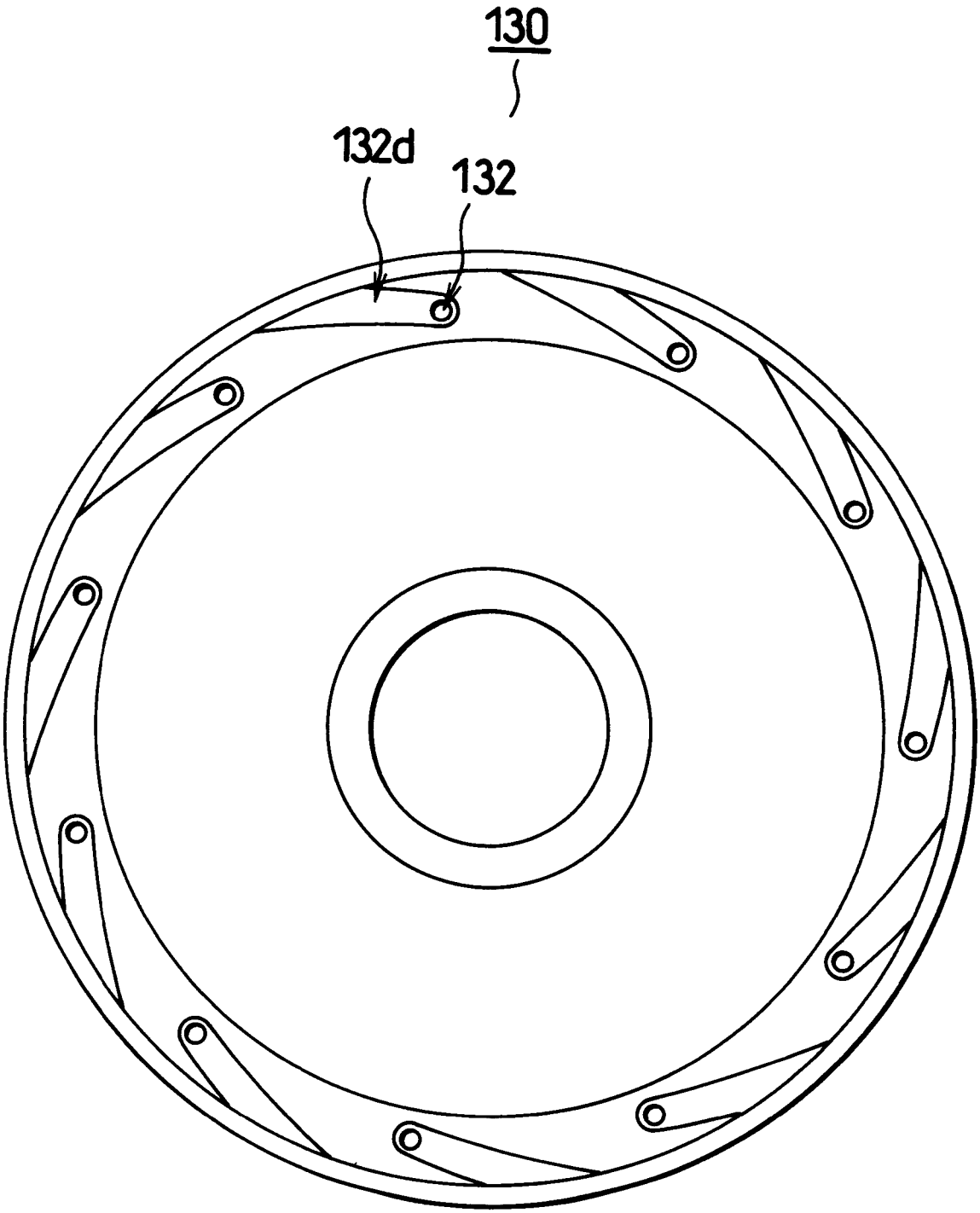
FIG. 33 is a top plan view of a fan case having the cavity suppressor of FIG. 32.
Figure 34:
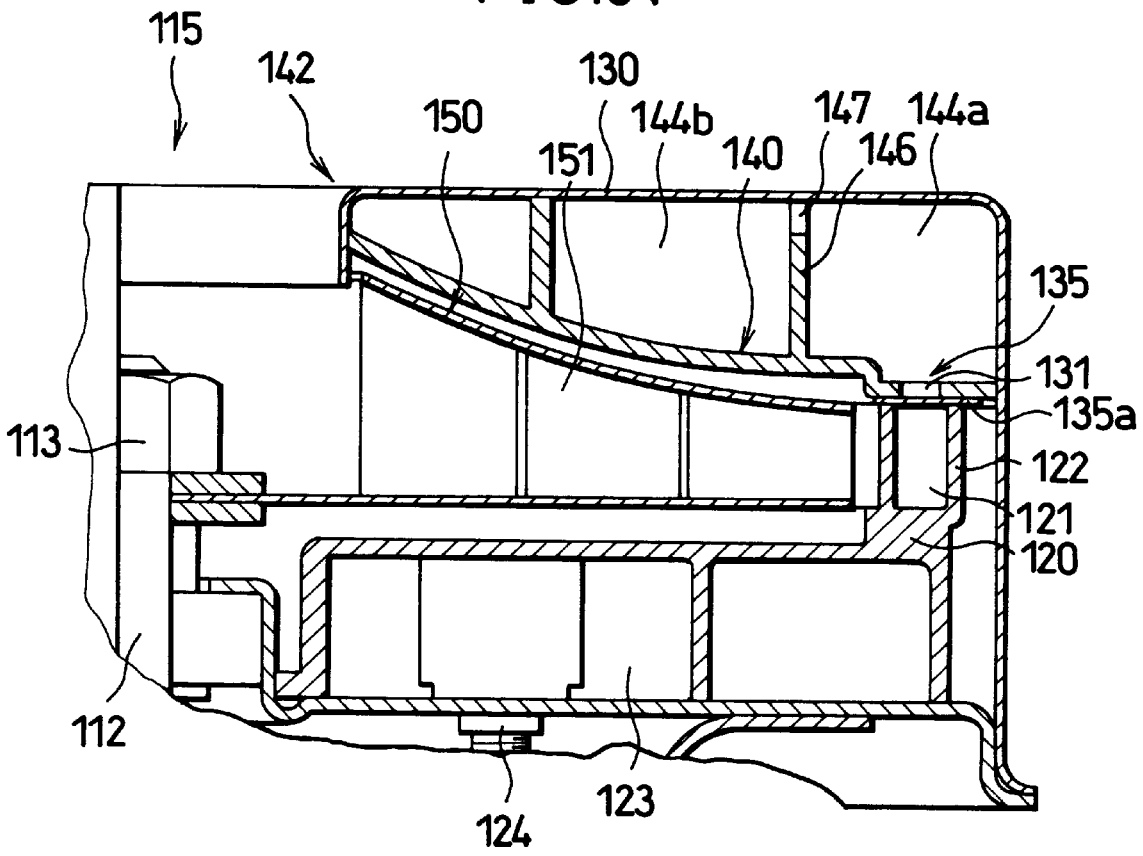
FIG. 34 is an enlarged cross section of a ninth electric fan according to the invention, showing in detail the structure of a noise transmitter formed in the silencer, capable of preventing the air flow through it.

Still another alternative cavity suppressor 132*d* is shown in FIG. 32. The cavity suppressor 132*d* has an elongate curved surface which is recessed upward (i.e. towards the silencer chambers 144) and extending generally towards the periphery of the fan case 130 as shown in a top plan view, FIG. 33. The transverse cross section of the recess is approximately a semi-circle. Formed at the top of the curved surface is a throughhole 132.

This type of cavity suppressor may also relieve pressure imbalance across the throughhole 132, thereby preventing or suppressing turbulence and hence the cavity noise caused by the throughhole 132.

Accordingly, the fluid friction in the air passage is reduced by the cavity suppressor, so that performance of the electric fan is improved.

Referring now to FIGS. 34 through 38, there is shown a ninth example of the invention, which is similar in structure to the fifth example. The ninth example differs from the fifth in that the cavity suppressor of this example is provided with a noise transmitter 135 which allows transmission of NZ noise from an air passages 121 to its silencer chamber 144*a* while preventing an airflow into the small silencer chamber 144*a*.

The noise transmitter 135 includes a throughhole 131, which is the same as in the fifth example, and a plastic film 135*a* which is attached on the mouth of the throughhole 131 facing the air passage 121 to cover the throughhole 131.

With this noise transmitter 135, acoustic energy propagating in the air passage 121 is allowed to pass through the film 131*a* into the silencer chambers 144 and advantageously absorbed by the silencer chambers 144, thereby annihilating the NZ noise. In addition, cavity noise may be prevented since the film 135*a* prevents airflow from the air passage 121 into the silencer chamber 144 caused by pressure imbalance, as described before. It should be appreciated that the elimination of the cavity noise with noise transmitter 135 reduces the fluid friction of the airflow in the air passage 121, and hence the performance of the electric fan is improved.

Figure 35:
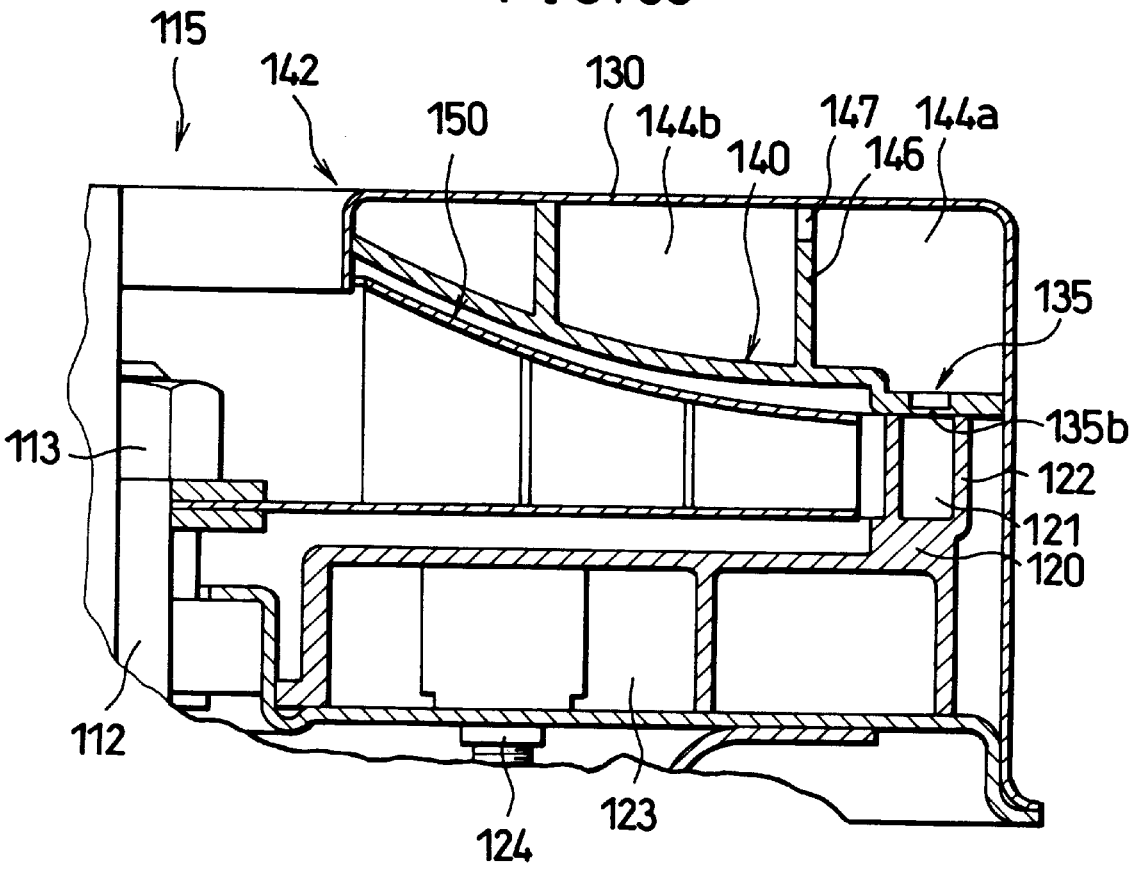
FIG. 35 is an enlarged cross section of another noise transmitter provided in the electric fan of FIG. 34.
Figure 36:
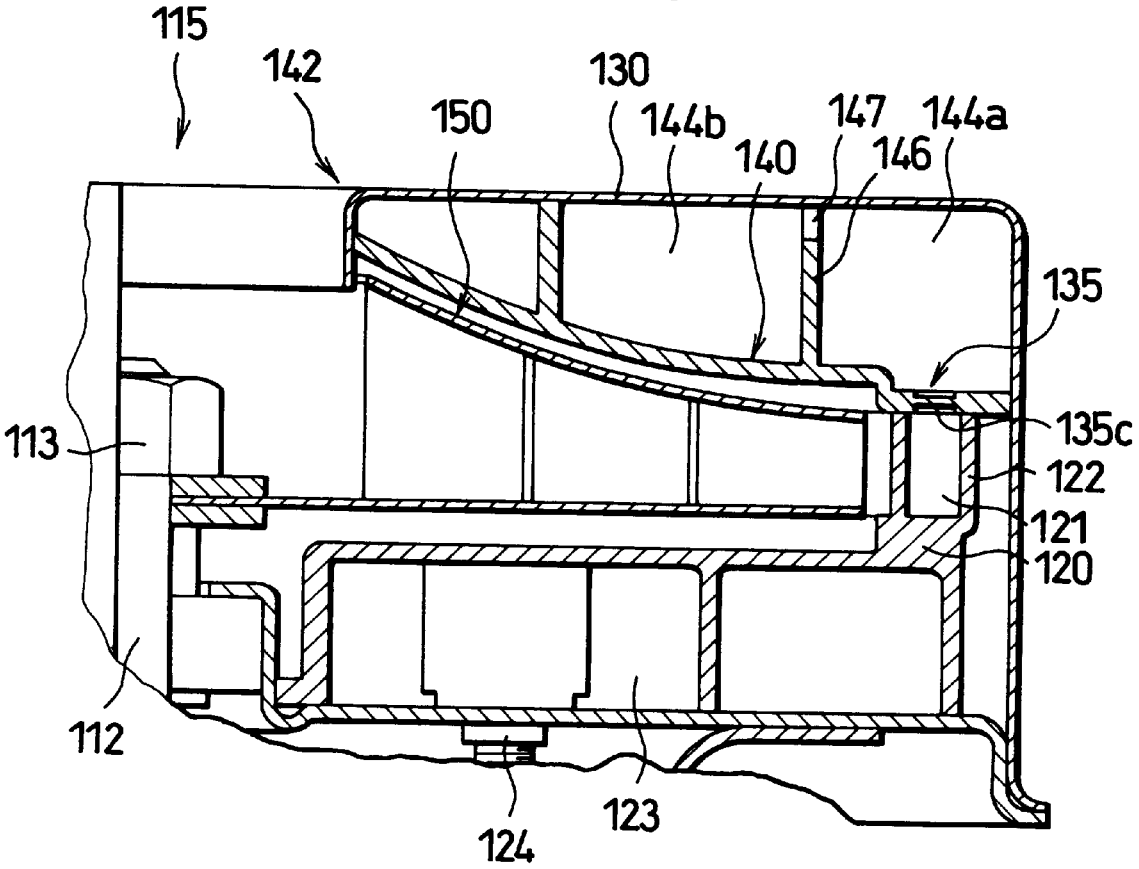
FIG. 36 is an enlarged cross section of a further noise transmitter provided in the electric fan of FIG. 34.
Figure 37:
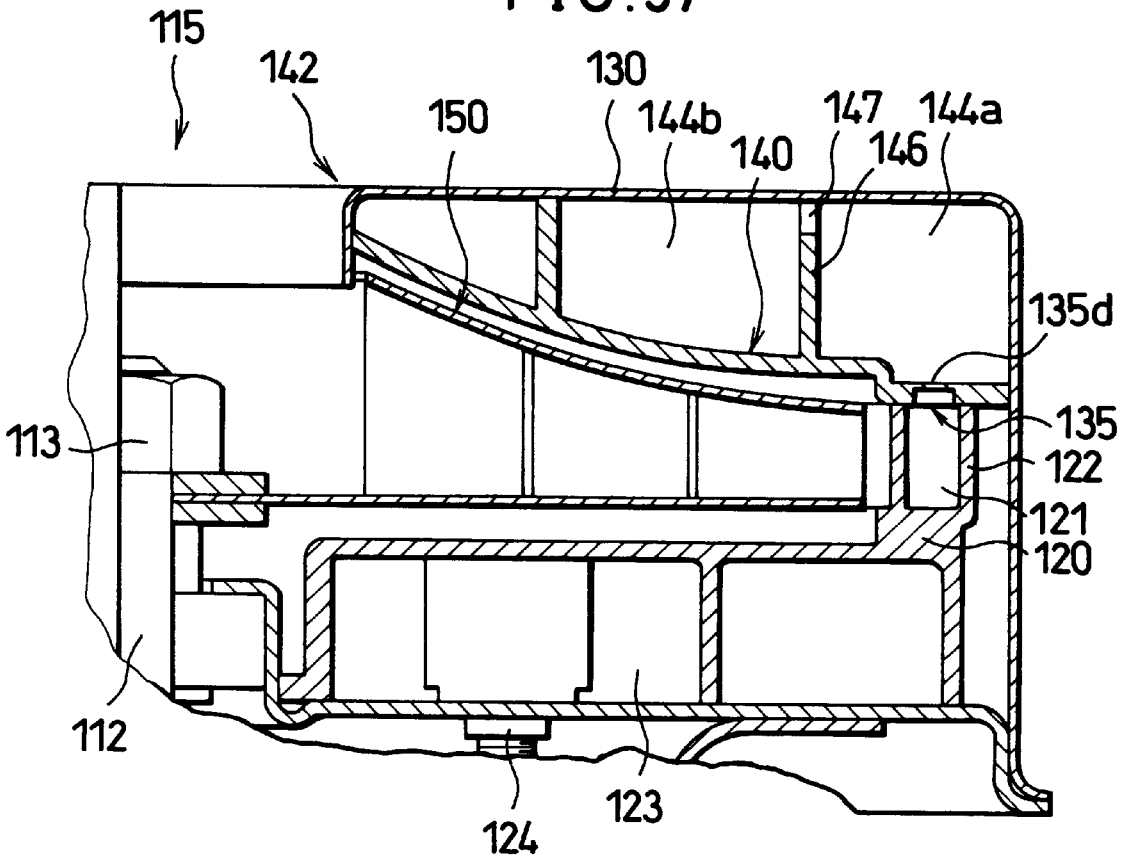
FIG. 37 is an enlarged cross section of still further noise transmitter provided in the electric fan of FIG. 34.

It would be understood that noise transmitter 135 may have any other configuration with or without the film 135*a*, so long as it can stop the airflow from the air passage 121 into the silencer chambers 144 and permits transmission of NZ noise alone. For example, the film 135*a* may be a part of the wall of the noise transmitter 135 extending over the throughhole 131, as shown in FIGS. 35 through 37. These figures illustrate three examples of noise transmitter 135 having a thin wall extension (or a thin layer) 135*b* at the lower end facing the air passage 121 (FIG. 35), a thin wall extension 135*c* at an intermediate position (FIG. 36), and a thin wall extension 135*d* at the upper end (FIG. 37), respectively, of the noise transmitter 135. The noise transmitter 135 may be fabricated by first boring a throughhole in the fan case 130 and then covering the throughhole with a thin layer.

Figure 38:
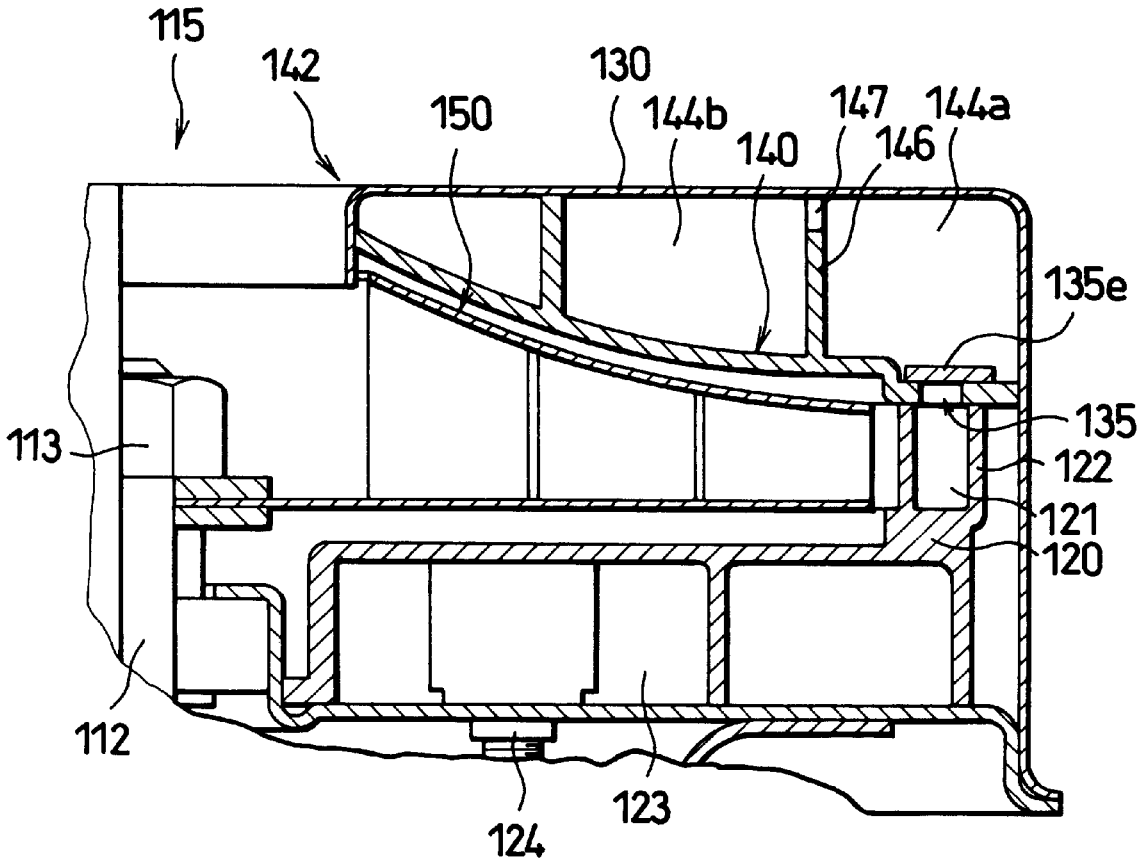
FIG. 38 is an enlarged cross section of still further noise transmitter provided in the electric fan of FIG. 34.

It is also possible to cover the upper end of the throughhole (or the end of the throughhole facing the silencer chambers 144) with a layer of noise absorbing material 135*e* such as urethane, as shown in FIG. 38.

Figure 39:
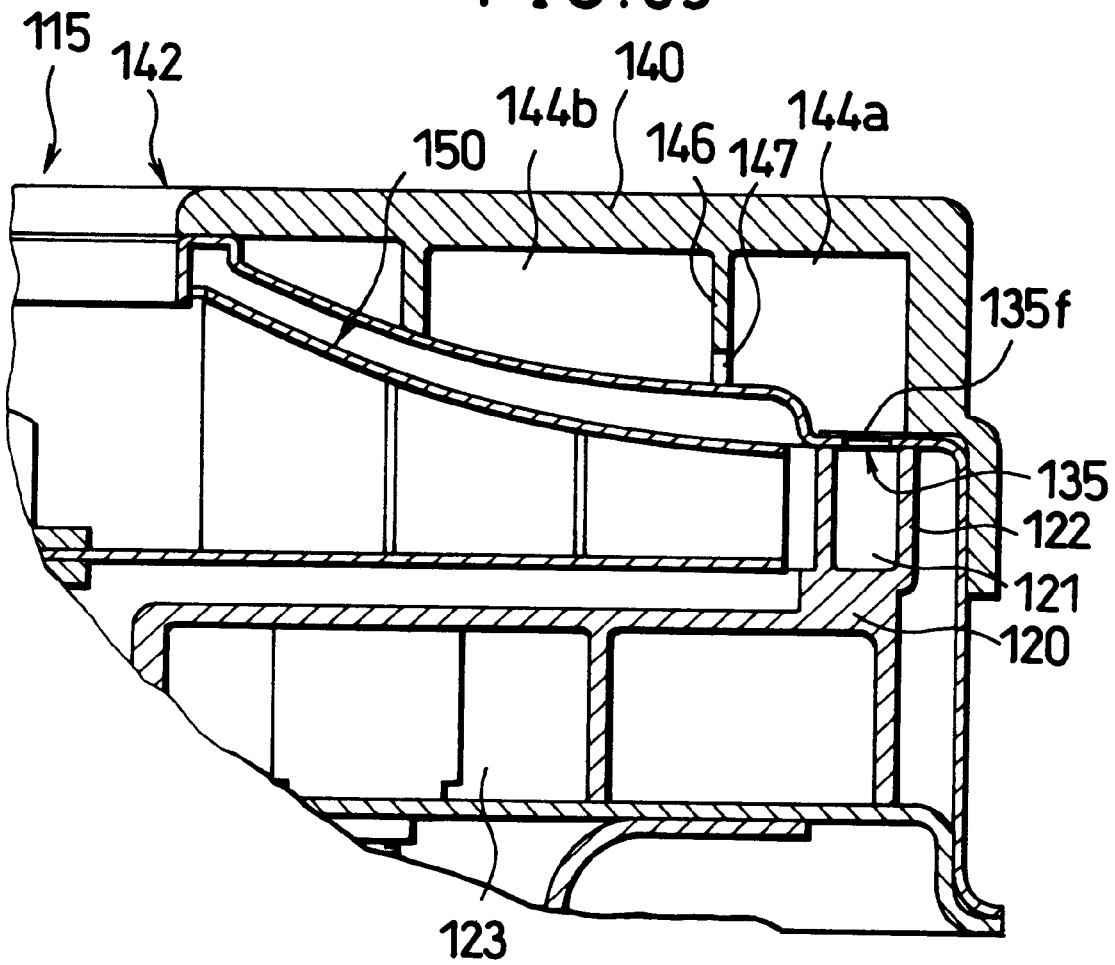
FIG. 39 is an enlarged cross section of a tenth electric fan according to the invention, showing in detail the structure of a noise transmitter formed in the silencer, capable of preventing the air flow through it.
Figure 40:
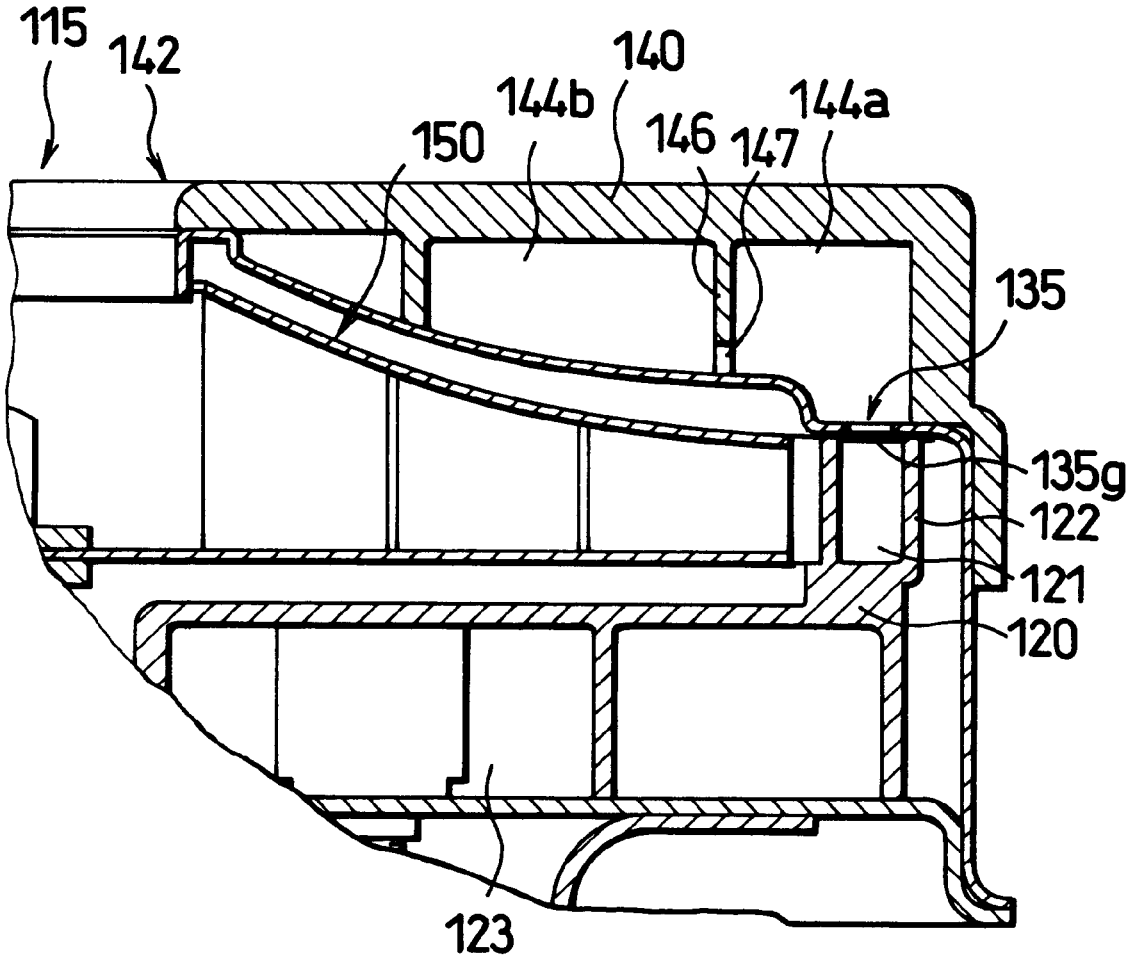
FIG. 40 is an enlarged cross section of a further noise transmitter provided in the electric fan of FIG. 39.
Figure 41:
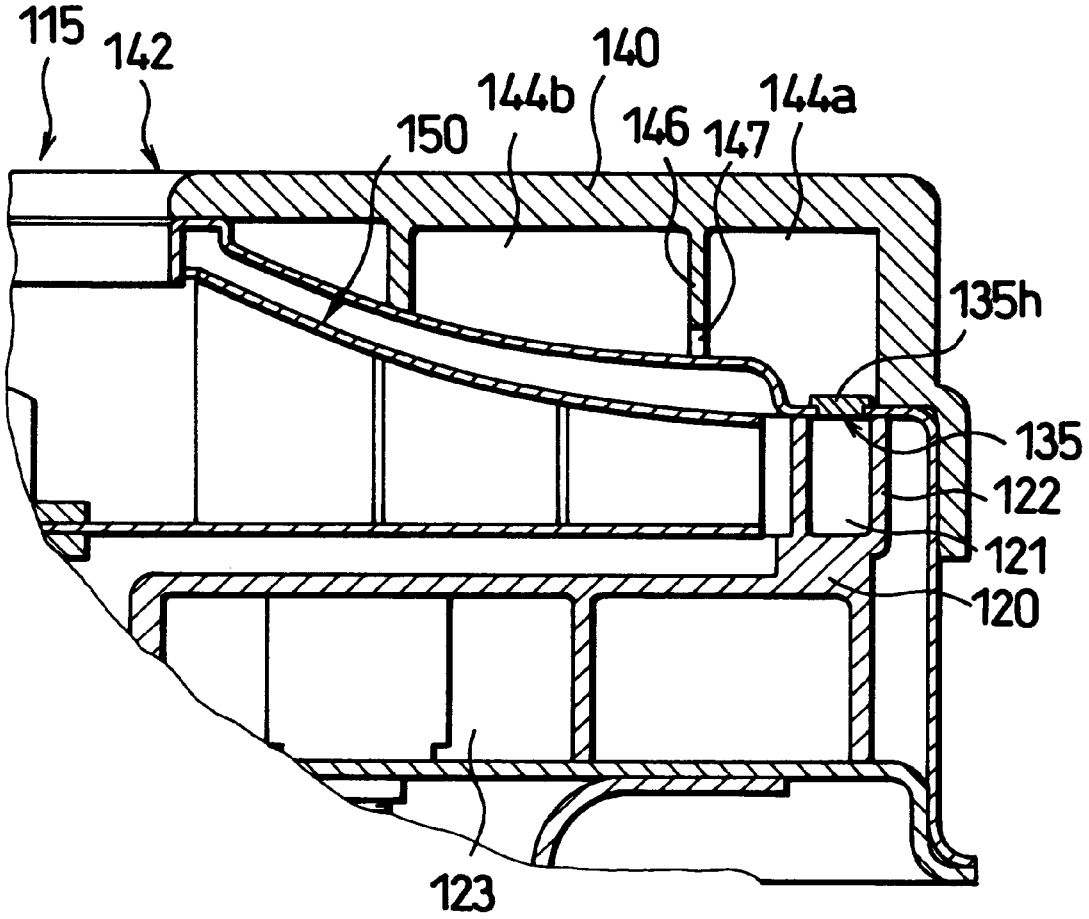
FIG. 41 is an enlarged cross section of a still further noise transmitter provided in the electric fan of FIG. 39.

Referring now to FIGS. 39 through 41, there is shown a tenth example, which is similar to the sixth example having a silencer on top of the fan case. However, this example differs from the sixth example in that the throughhole between the air passage 121 and a small silencer chamber 144*a* is provided with a noise transmitter 135, as in the ninth example, so that airflow from the air passage 121 to the small silencer chamber is prohibited.

In a specific example shown in FIG. 39, because the silencer 140 is arranged to cover an impeller 150, the noise transmitter 135 consists of the throughhole and a plastic film 135*f* covering the throughhole. As in the preceding examples, NZ noise is allowed to enter from the air passage 121 into the silencer chambers 144 to be annihilated therein, but the air is prohibited from entering the throughhole or the silencer chambers.

It would be apparent that the configuration of the noise transmitter of this example is not limited to the one illustrated in FIG. 39. For example, it may be a film 135*g* mounted between the air passage 121 and the fan case 130 such that it such that it sealingly covers the throughhole, as shown in FIG. 40, or it may be a thin layer of urethane 135*h* fitted to close the throughhole, as shown in FIG. 41.

In as much as the present invention is subject to many variations, modifications and changes in detail, it is intended that the subject matter discussed above and shown in the accompanying drawings may be interpreted as illustrative not in a limiting sense.

What is claimed is:

1. An electric fan comprising:

a radial impeller for expelling the air trapped therein out of said impeller;

a diffuser having a multiplicity of air passages separated by air guides, said air passages adapted to receive the air expelled from said impeller;

a fan case for covering said impeller and said air passages; and a silencer covering said fan case and being equipped with a multiplicity of dead-ended silencer cavities each having a predetermined volume, each said silencer cavity having an open-end facing, and being coupled with, a corresponding one of said air passages.

2. The electric fan as defined in claim 1, wherein said silencer has at the center thereof an air intake port whose entrance is chamfered round to facilitate a laminar flow of air through said air intake port.

3. The electric fan as defined in claim 1 wherein each silencer cavity is coupled to said corresponding air passage by a through-hole establishing communication between said silencer cavity and the corresponding air passage.

4. The electric fan as defined in claim 3, wherein each said cavity of said silencer is divided into a multiplicity of series-connected silencer chambers communicating with each other by means of throughholes.

5. The electric fan as defined in claim 4, wherein said selected ones of said silencer chambers are communicated through a cut formed in a rib that partitions said selected silencer chambers.

6. The electric fan as defined in claim 5, wherein said selected ones of said silencer chambers have different volumes, and wherein said throughhole associated with said silencer chambers is formed in the smaller chamber while the larger chamber is communicated with the smaller chamber through said cut.

7. The electric fan as defined in claim 3, wherein said throughhole is provided with a cavity suppressor for suppressing the interference between said throughhole and the air that passes through said air passage.

8. The electric fan as defined in claim 7, wherein said cavity suppressor has a shape such that the downstream end of said cavity suppressor has a smoother configuration that the upstream end thereof.

9. The electric fan as defined in claim 1, wherein each of said air passages is couple to a corresponding silencer cavity by a noise transmitter disposed over a throughhole associated with said air passage, for prohibiting airflow from said air passage into said silencer cavity and acoustically coupling said air passage with said silencer cavity.

10. An electric fan comprising:

a radial impeller for expelling the air trapped therein out of said impeller;

a diffuser having a multiplicity of air passages separated by air guides, said air passages adapted to receive the air expelled from said impeller;

a silencer covering said impeller and said air guides and being equipped with a multiplicity of dead-ended cavities each having a predetermined volume, each said silencer cavity having an open end facing, and being coupled with, a corresponding one of said air passages; and a fan case covering said silencer.

11. The electric fan as defined in claim 10, wherein said fan case has an air intake port whose entrance is chamfered round to facilitate a laminar flow of air through said air intake port.

12. The electric fan as defined in claim 10 wherein each cavity is couple to said corresponding air passage by a through-hole establishing communication between said cavity and the corresponding air passage.

13. The electric fan as defined in claim 12, wherein said cavity is divided into a multiplicity of series-connected silencer chambers communicating with said air passages through said throughholes.

14. The electric fan as defined in claim 13, wherein selected ones of said silencer chambers are communicated through a cut formed in a rib that partitions said selected silencer chambers.

15. The electric fan as defined in claim 14, wherein said selected ones of said silencer chambers have different volumes, and wherein said throughhole associated with said silencer chambers is formed in the smaller chamber while the larger chamber is communicated with the smaller chamber through said cut.

16. The electric fan as defined in claim 12, wherein said throughhole is provided with a cavity suppressor for suppressing the interference between said throughhole and the air that passes through said air passage.

17. The electric fan as defined in claim 16, wherein said cavity suppressor has a shape such that the downstream end of said cavity suppressor has a smoother configuration than the upstream end thereof.

18. The electric fan as defined in claim 9, wherein each of said air passages is coupled to a corresponding cavity by a noise transmitter disposed over a throughhole associated with said air passage, for prohibiting airflow from said air passage into said silencer cavity and acoustically coupling said air passage with said silencer cavity.

* * * * *